US006953240B2

(12) United States Patent
Cabal et al.

(10) Patent No.: US 6,953,240 B2
(45) Date of Patent: Oct. 11, 2005

(54) SNAP-THROUGH THERMAL ACTUATOR

(75) Inventors: Antonio Cabal, Webster, NY (US); John A. Lebens, Rush, NY (US); David P. Trauernicht, Rochester, NY (US); David S. Ross, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/015,999

(22) Filed: Dec. 18, 2004

(65) Prior Publication Data

US 2005/0099462 A1 May 12, 2005

Related U.S. Application Data

(62) Division of application No. 10/145,911, filed on May 15, 2002, now Pat. No. 6,869,169.

(51) Int. Cl.[7] ..... B41J 2/04; B41J 2/05

(52) U.S. Cl. ..... 347/54; 347/56; 347/65

(58) Field of Search ..... 347/17, 20, 40–43, 347/49, 54, 56, 61, 63–65, 68; 310/306, 307; 60/527–529; 216/27

(56) References Cited

U.S. PATENT DOCUMENTS

| | | | |
|---|---|---|---|
| 3,747,120 | A | 7/1973 | Stemme |
| 3,946,398 | A | 3/1976 | Kyser et al. |
| 4,296,421 | A | 10/1981 | Hara et al. |
| 5,599,695 | A | 2/1997 | Pease et al. |
| 5,684,519 | A | 11/1997 | Matoba et al. |
| 5,771,882 | A | 6/1998 | Psaros et al. |
| 5,785,295 | A | 7/1998 | Tsai |
| 5,812,163 | A | 9/1998 | Wong |
| 5,902,648 | A | 5/1999 | Naka et al. |
| 5,905,241 | A | 5/1999 | Park et al. |
| 6,067,797 | A | 5/2000 | Silverbrook |
| 6,079,813 | A | 6/2000 | Tuli |
| 6,087,638 | A | 7/2000 | Silverbrook |
| 6,168,395 | B1 | 1/2001 | Quenzer et al. |
| 6,180,427 | B1 | 1/2001 | Silverbrook |
| 6,234,609 | B1 | 5/2001 | Silverbrook |
| 6,239,821 | B1 | 5/2001 | Silverbrook |
| 6,243,113 | B1 | 6/2001 | Silverbrook |
| 6,254,793 | B1 | 7/2001 | Silverbrook |
| 6,274,056 | B1 | 8/2001 | Silverbrook |
| 6,481,821 | B1 | 11/2002 | Yun et al. |

FOREIGN PATENT DOCUMENTS

| | | |
|---|---|---|
| JP | 10041518 | 2/1998 |
| JP | 11240150 | 7/1999 |

*Primary Examiner*—Stephen Meier
*Assistant Examiner*—An H. Do
(74) *Attorney, Agent, or Firm*—William R. Zimmerli

(57) ABSTRACT

A snap-through thermal actuator for a micro-electromechanical device, for example, a liquid drop emitter or a fluid control microvalve, is disclosed. The snap-through actuator includes a base element formed with a depression having opposing anchor edges which define a central plane. A deformable element, attached to the base element at the opposing anchor edges, is constructed as a planar lamination including a first layer of a first material having a low coefficient of thermal expansion and a second layer of a second material having a high coefficient of thermal expansion. The deformable element is formed to have a residual shape bowing outward from the central plane in a first direction away from the second layer. The snap-through thermal actuator further includes apparatus adapted to apply a heat pulse to the deformable element which causes a sudden rise in the temperature of the deformable element.

50 Claims, 27 Drawing Sheets

SNAP-THROUGH THERMAL ACTUATOR

This application is a divisional of prior application Ser. No. 10/145,911, filed May 15, 2002 now U.S. Pat. No. 6,869,169.

FIELD OF THE INVENTION

The present invention relates generally to micro-electromechanical devices and, more particularly, to micro-electromechanical thermal actuators such as the type used in ink jet devices and other liquid drop emitters.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices. Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission and micro fluid valving is needed which can be used with a broad range of liquid formulations. Apparatus are needed which combine the advantages of microelectronic fabrication used for thermal ink jet with the liquid composition latitude available to piezo-electro-mechanical devices.

A DOD ink jet device which uses a thermo-mechanical actuator was disclosed by Matoba, et al in U.S. Pat. No. 5,684,519. The actuator is configured as a thin beam constructed of a single electroresistive material located in an ink chamber opposite an ink ejection nozzle. The beam buckles due to compressive thermo-mechanical forces when current is passed through the beam. The beam is pre-bent into a shape bowing towards the nozzle during fabrication so that the thermo-mechanical buckling always occurs in the direction of the pre-bending.

R. Tuli in U.S. Pat. No. 6,079,813 discloses an ink jet printhead device which uses a stressed thin film applied over a base substrate. Cavities are etched underneath the film creating a membrane film which has the tendency to bulge outward over cavity areas under the effect of internal compressed forces. The membrane film, and the bottom of the cavity, have electrodes deposited. An electric signal corresponding with input data is applied to two electrodes creating an electric field between electrodes. As a result, the membrane film is attracted and repelled against the fixed cavity bottom, following the electric signal and providing a variation of an adjacent ink chamber's volume ejecting an ink drop. In its displacement, the membrane film snaps, after passing the zone where the force created by the electric field adds to the internal compressed forces of the film, accelerating its displacement from one stable position into another.

A bistable, bilayer membrane actuator is used to open and close microvalves in a pumping device disclosed by Quenzer, et al. in U.S. Pat. No. 6,168,395. The membrane resides in a buckled configuration induced by compressive strains in the two different materials that compose the bilayer. Electrostatic forces are used to attract the membrane causing it to snap from a buckled-out to a buckled-in position, thereby opening and closing a valve. However, the electrostatic forces that can be reliably generated are weak and membrane sticking problems can limit the long term usefulness.

Park, et al., in U.S. Pat. No. 5,905,241 disclose a bilayer thin film microbeam actuator which snaps between stable states of buckle-out and buckle-in in response to mechanical load forces. The switch is used, for example, to trigger an airbag in response to over-threshold acceleration forces in a vehicle crash. The bilayer microbeam resides in a buckled position due to compressive strains introduced in the two materials of the beam during fabrication. In operation, an excessive acceleration of the mounting structure of the beam causes it to snap through to the opposite buckle state, opening or closing an electric switch.

Disclosures of a thermo-mechanical DOD ink jet configuration have been made by K. Silverbrook in U.S. Pat. Nos. 6,067,797; 6,087,638; 6,239,821 and 6,243,113. Methods of manufacturing thermo-mechanical ink jet devices using microelectronic processes have been disclosed by K. Silverbrook in U.S. Pat. Nos. 6,180,427; 6,254,793 and 6,274,056. The thermal actuators disclosed are of a bilayer cantilever type in which a thermal moment is generated between layers having substantially different coefficients of thermal expansion. Upon heating the cantilevered microbeam bends away from the layer having the higher coefficient of thermal expansion, deflecting the free end and causing liquid drop emission.

Thermo-mechanically actuated drop emitters are promising as low cost devices which can be mass produced using microelectronic materials and equipment and which allow operation with liquids that would be unreliable in a thermal ink jet device. Large and reliable force actuations can be realized by thermally cycling bilayer configurations. However, operation of thermal actuator style drop emitters, at high drop repetition frequencies, requires careful attention to the energy needed to cause drop ejection in order to avoid excessive heat build-up. The drop generation event relies on creating a large pressure impulse in the liquid at the nozzle. Configurations and designs that maximize the force impulse may therefore operate more efficiently and may be useable with fluids having higher viscosities and densities.

Binary fluid microvalve applications benefit from rapid transitions from open to closed states, thereby minimizing the time spent at intermediate pressures. A thermo-mechanical actuator with improved force strength and transition movement speed will allow more accurate and predictable microvalving and fluid metering.

Binary microswitch applications also benefit from rapid transitions from open to closed states, thereby minimizing the time spent at indeterminate electrical states. A thermo-mechanical actuator with improved force strength and transition movement speed will allow more accurate and predictable microswitching and electrical circuit control.

A useful design for thermo-mechanical actuators is a beam, or a plate, anchored at opposing edges to the device structure and capable of bowing outward at its center, providing mechanical actuation which is perpendicular to the nominal rest plane of the beam or plate. Such a configuration for the moveable member of a thermal actuator will be termed a deformable element herein and may have a variety of planar shapes and amount of perimeter anchoring. The deformation of the deformable element is caused by initially setting up thermal expansion effects within the plane of the deformable element. Both bulk expansion and contraction of the deformable element material, as well as gradients within the thickness of the deformable element, are useful in the design of thermo-mechanical actuators. Such expansion gradients may be caused by temperature gradients or by actual materials changes, layers, thru the deformable element. These bulk and gradient thermo-mechanical effects may be used together to design an actuator that operates by snap-through buckling maximizing the net magnitude and speed of mechanical actuation, thereby improving the performance of liquid drop emitters, fluid microvalves, and electrical microswitches.

Snap-through thermal actuators, which can be operated at acceptable peak temperatures while delivering large force magnitudes and accelerations, are needed in order to build systems that operate with a variety of fluids at high frequency and can be fabricated using MEMS fabrication methods.

SUMMARY OF THE INVENTION

It is therefore an object of the present invention to provide a snap-through thermal actuator which provides large force magnitudes and accelerations and which does not require excessive peak temperatures.

It is also an object of the present invention to provide a liquid drop emitter which is actuated by a snap-through thermal actuator.

It is also an object of the present invention to provide a fluid microvalve which is actuated by a snap-through thermal actuator.

It is also an object of the present invention to provide an electrical microswitch which is actuated by a snap-through thermal actuator.

The foregoing and numerous other features, objects and advantages of the present invention will become readily apparent upon a review of the detailed description, claims and drawings set forth herein. These features, objects and advantages are accomplished by constructing a snap-through thermal actuator for a micro-electromechanical device comprising a base element formed with a depression having opposing anchor edges which define a central plane. A deformable element, attached to the base element by a semi-rigid connection at the opposing anchor edges, is constructed as a planar lamination including a first layer of a first material having a low coefficient of thermal expansion and a second layer of a second material having a high coefficient of thermal expansion. The deformable element is formed to have a residual shape bowing outward from the central plane in a first direction away from the second layer. The snap-through thermal actuator further comprises apparatus adapted to apply a heat pulse to the deformable element which causes a sudden rise in the temperature of the deformable element. The deformable element initially bows farther outward in the first direction, then reverses and snaps through the central plane to bow outward in a second direction toward the second layer, and then relaxes to the residual shape as the temperature decreases.

The present invention is particularly useful as a thermal actuator for liquid drop emitters used as printheads for DOD ink jet printing. In this preferred embodiment the snap-through thermal actuator resides in a liquid-filled chamber that includes a nozzle for ejecting liquid. Application of a heat pulse to the deformable element of the snap-through thermal actuator initially causes additional bowing in the direction of a residual bowing followed by a snap-through buckling in the opposite direction forcing liquid from the nozzle.

The present invention is useful as a thermal actuator for fluid microvalves used as in fluid metering devices or systems needing rapid pressure switching. In this preferred embodiment a snap-through thermal actuator resides in a fluid-filled chamber that includes a fluid flow port. The snap-through actuator acts to close or open the fluid flow port for normally open valve or normally closed valve embodiments of the present inventions. Application of a heat pulse to the deformable element of the snap-through thermal actuator initially causes additional bowing in the direction of a residual bowing followed by a snap-through buckling in the opposite direction causing the opening or closing of the fluid flow port.

The present invention is also useful as a thermal actuator for electrical microswitches used to control electrical circuits requiring rapid switching with a minimum of time spent at indeterminate electrical states. In this preferred embodiment a snap-through thermal actuator activates a control electrode that makes or breaks contact with switch electrodes to open or close an external circuit. Application of a heat pulse to the deformable element of the snap-through thermal actuator initially causes additional bowing in the direction of a residual bowing followed by a snap-through buckling in the opposite direction causing the rapid opening or closing of the microswitch.

DETAILED DESCRIPTION OF THE INVENTION

Figure 1A:
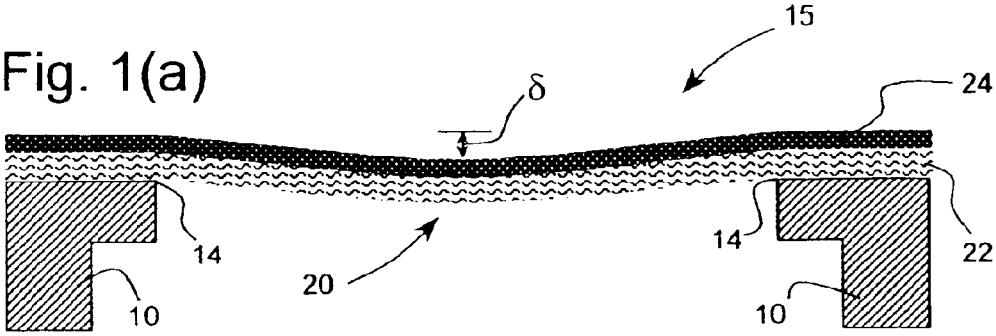
FIG. 1 is a schematic illustration of the motion of a snap-through thermal actuator according to the present invention.

The invention has been described in detail with particular reference to certain preferred embodiments thereof, but it will be understood that variations and modifications can be effected within the spirit and scope of the invention.

As described in detail herein below, the present invention provides apparatus for a snap-through thermal actuator, a drop-on-demand liquid emission device, and normally closed and normally open microvalves. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide drop emitters based on thermo-mechanical actuators having improved drop ejection performance for a wide range of fluid properties. The inventions further provide microvalves with improved closing and opening force and speed.

The inventors of the present inventions have discovered that a clamped, deformable element type micro thermal actuator may be designed to exhibit snap-through buckling generated by internal thermo-mechanical forces. Previously known snap-through actuators of the clamped boundary type have needed the application of external transverse forces to cause the snap-through buckling phenomenon to occur. Snap-through bucking is distinguished over normal buckling in that the deformable plate or beam suddenly transitions from a buckled-out state to a buckled-in state, or vice versa. In making this transition, the element is forced through a constricted central plane releasing substantial stored energy of compression. Further, in practicing the present inventions, the snap-through buckling behavior utilized involves a deformable element that has a residual bowing in one direction from a central plane. Upon heating the deformable element first bows farther in the same direction as the residual bowing before reaching a temperature and internal stress conditions that triggers snap-through buckling to the opposite side of the central plane.

FIG. 1 illustrates in side view the snap-through effect that is the basis of the present inventions. A deformable element 20 is anchored to a base element 10 at two opposing anchor edges 14. The illustrated deformable element is a thin beam comprised of two layers first layer 22 and second layer 24. First layer 22 is constructed of a material having a low coefficient of thermal expansion, such as a silicon oxide or nitride. Second layer 24 is constructed of a material having a high coefficient of thermal expansion such as a metal. FIG. 1*a* shows the deformable element 20 at rest at a nominal operating temperature. An important feature of the present inventions is the slight bowing away from the second layer 24, having a central deflection magnitude 6 as shown. This residual shape predisposes the deformable element to bow away from the second layer if the ends are compressed.

The geometry of the snap-through thermal actuator 15 illustrated in FIG. 1, and in the other figures herein, is not to scale for typical microbeam structures. Typically, first layer 22 and second layer 24, are formed a few microns in thickness and the length of the microbeam, L, is more than 100 microns.

Figure 1B:
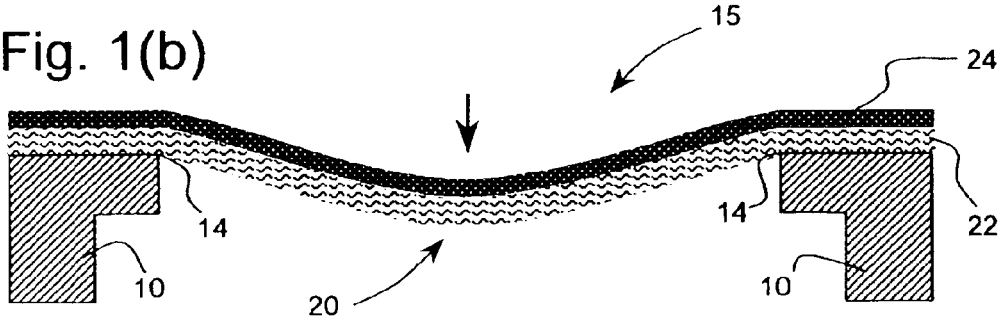

FIG. 1*b* illustrates the initial behavior of the beam when heated. The beam expands with temperature and, because of the residual shape bowed toward first layer 22 (downward in the FIG. 1), the beam buckles downward. As will be explained below, while initially buckling downward, an internal thermal moment is also acting due to the thermal expansion mismatch between first layer 22 and second layer 24. This thermal moment has force components which twist the anchored ends of the bean upward, towards the layer of larger thermal expansion coefficient. If the anchoring connection is semi-rigid rather than rigid, the thermal moment can reverse the buckling and cause the beam to make a snap-through transition as illustrated in FIG. 1*c* to a buckled-up state, FIG. 1*d*.

Figure 1C:
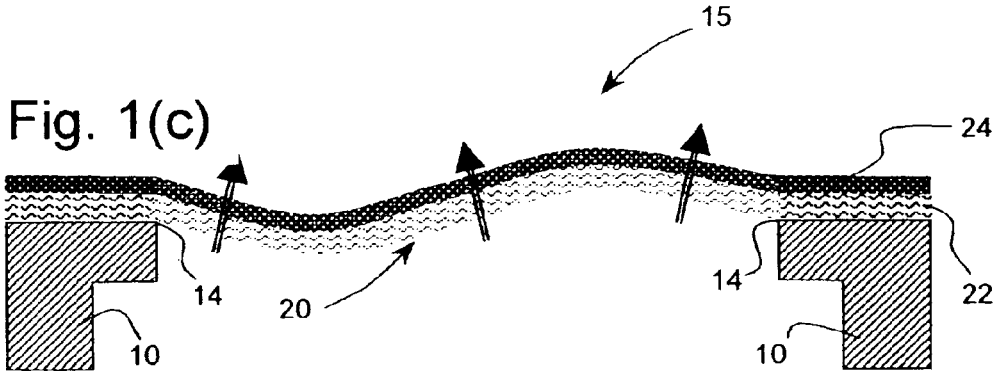
Figure 1D:
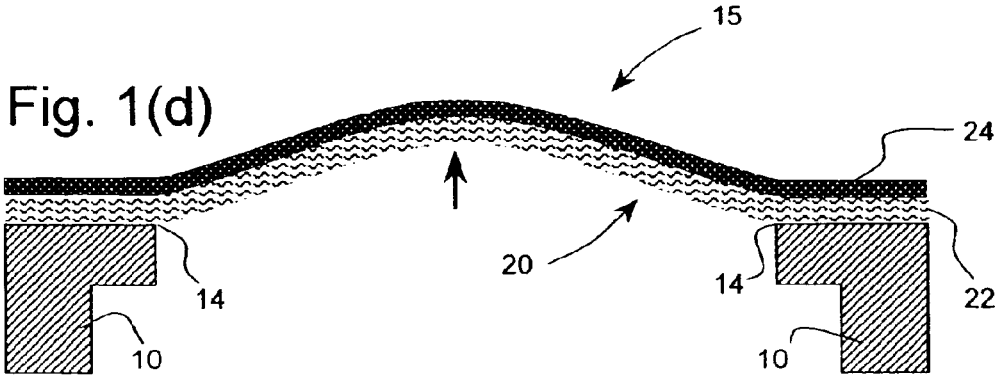

The beam shape in FIG. 1*c* is merely illustrative of the snap-through process. The actual shape during snap-through may be a complex combination of normal vibration modes of the beam. Achieving a design which exhibits the snap-through behavior illustrated in FIG. 1 involves a selection of materials and geometrical properties of the layers of deformable element 20, the characteristics of the connection of the deformable element 20 to the opposing anchor edges 14, the magnitude and direction of the residual bowing, and the practical temperature range which can be utilized.

The beam will return to the residual shape illustrated as FIG. 1*a* upon cooling. This is another important feature of the present inventions. The snap-through thermal actuator is not bistable in that it does not remain in the buckled-up state when allowed to return to the rest temperature which exhibits the slight buckled-down residual shape.

Figure 2:
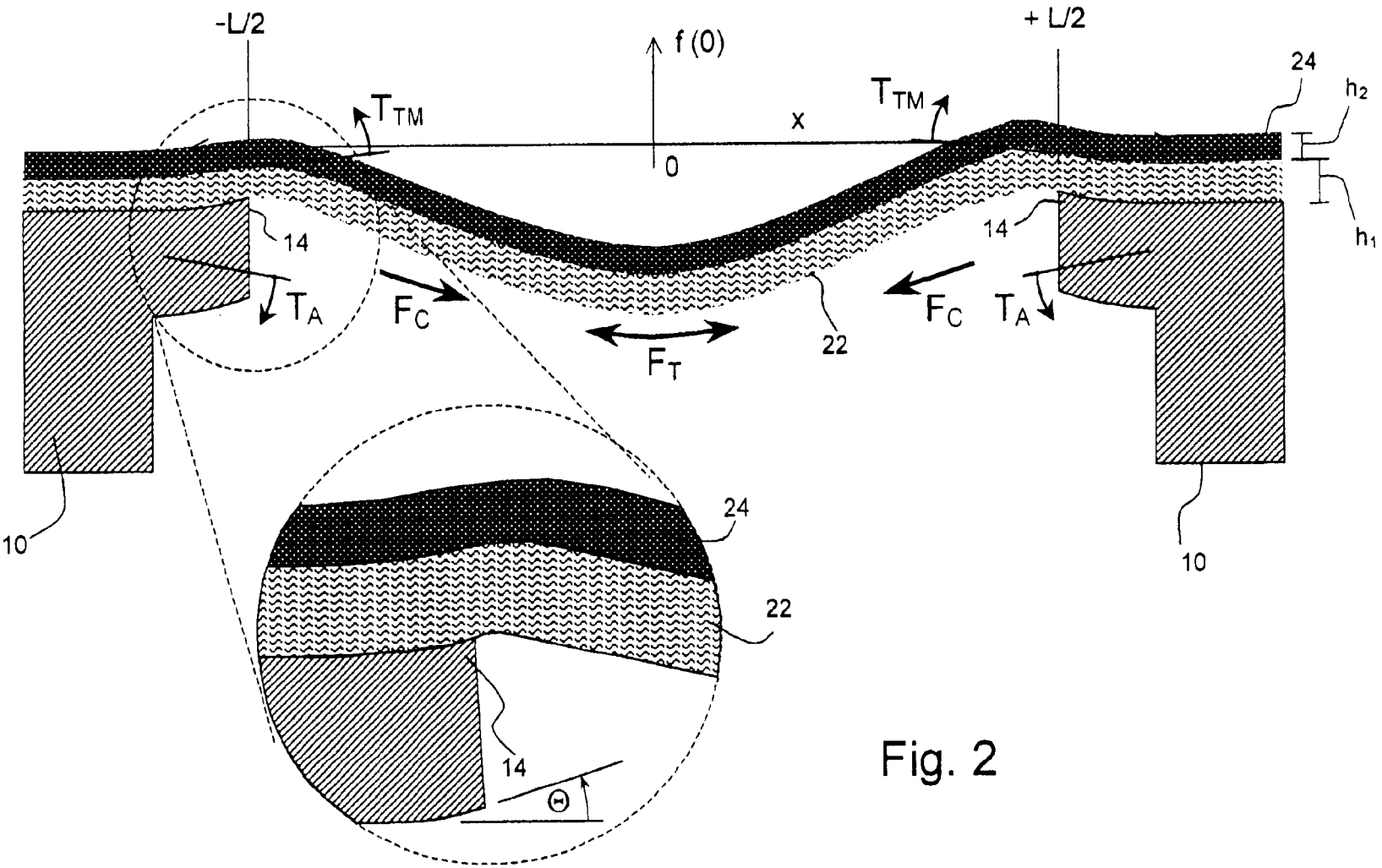
FIG. 2 is a side view of a deformable element illustrating the thermo-mechanical forces which act to cause snap-through motion according to the present invention.

A more detailed understanding of the physics underlying the snap-through behavior of a deformable element may be approached by analysis of the partial differential equations which govern a beam supported at two anchor points. The co-ordinates and geometrical parameters to be followed herein are illustrated in FIG. 2. The illustrated deformable element, a microbeam, is comprised of first layer 22 having a thickness of $h_1$ and second layer 24 having a thickness of $h_2$. The length of the microbeam between opposing anchor edges 14 is L. The x-axis in FIG. 2 is shown spanning the space between the opposing anchor edge locations 14. The x-axis resides in what will be termed herein the central plane of the deformable element 20. This plane marks the position of a deformable element that is flat, having no residual deformation or buckle.

The standard equation for small oscillations of a vibrating beam is $$\rho h\frac{\partial^2 u}{\partial t^2} + \frac{Eh^3}{12(1-\sigma^2)}\frac{\partial^4 u}{\partial x^4} = 0 \tag{1}$$

along with which various standard boundary conditions are used. Here, x is the spatial coordinate along the length of the beam, t is time, u(x,t) is the displacement of the beam, ρ is the density of the beam, h is its thickness, E is its Young's modulus, σ is its Poisson ratio. The co-ordinate system has been chosen with the origin in x at the center of the beam and zero deflection, u(x,t)=0 to be the position of a perfectly flat beam, i.e. at the central plane. The deflection at the microbeam center illustrated in FIG. 2 is, therefore, negative.

For a multilayer beam the physical constants are all effective parameters, computed as weighted averages of the physical constants of the various layers, j:

$$h = \sum_{j=1}^{N} h_j, \tag{2}$$

$$E = \frac{\sum_{j=1}^{N} E_j h_j}{\sum_{j=1}^{N} h_j}, \tag{3}$$

$$\rho = \frac{\sum_{j=1}^{N} \rho_j h_j}{\sum_{j=1}^{N} h_j}, \tag{4}$$

$$\alpha = \frac{\sum_{j=1}^{N} \frac{\alpha_j h_j E_j}{1-\sigma_j}}{\sum_{j=1}^{N} \frac{h_j E_j}{1-\sigma_j}}, \tag{5}$$

$$1-\sigma^2 = \frac{Eh^3}{12}\frac{1}{\sum_{j=1}^{N}\frac{1}{3}[(y_j-y_c)^3-(y_{j-1}-y_c)^3]\frac{E_j}{1-\sigma_j^2}}, \tag{6}$$

where $y_0 = 0$, $y_j = \sum_{k=1}^{j} h_k$, and $$y_c = \frac{\sum_{j=1}^{N}\frac{1}{2}\frac{E_j(y_j^2-y_{j-1}^2)}{1-\sigma_j^2}}{\sum_{j=1}^{N}\frac{E_j h_j}{1-\sigma_j^2}}. \tag{7}$$

$\alpha_j$ is the coefficient of thermal expansion of the $j^{th}$ layer and α is the effective coefficient of thermal expansion for the multilayer beam.

Standard Equation 1 is amended to account for several additional physical effects including the compression or expansion of the beam due to heating, residual strains and boundary conditions that account for the moments applied to the beam ends by the attachment connections.

The primary effect of heating the constrained microbeam is a compressive stress. The heated microbeam, were it not constrained, would expand. In constraining the beam against expansion, the attachment connections compress the microbeam between the opposing anchor edges 14. For an undeformed shape of the microbeam, this thermally induced stress may be represented by adding a term of the form:

$$Eh\alpha T\frac{\partial^2 u}{\partial x^2} \tag{8}$$

to Equation 1. In Equation 8 above, α is the mean coefficient of thermal expansion given in Equation 5, and T is the temperature. Such a term would represent a uniformly compressed beam. The compressive stress forces acting on the beam are schematically indicated as $F_C$ in FIG. 2.

However, the microbeam is not compressed uniformly. It is deformed, bowed outward, and the deformation will mitigate the compression. The local expansion of the microbeam is:

$$\sqrt{1+\left(\frac{\partial u}{\partial x}\right)^2}-1\cong\frac{1}{2}\left(\frac{\partial u}{\partial x}\right)^2. \tag{9}$$

The right hand term in Equation 9 is the first term in a Taylor expansion of the full expression on the left side of the equation. The right hand side term will be used herein as an approximation of the local expansion, justified by the very small magnitude of the deformations which are involved. Using the Taylor approximation in Equation 9, the net thermally induced local strain is:

$$\alpha T-\frac{1}{2}\left(\frac{\partial u}{\partial x}\right)^2. \tag{10}$$

The tensile stresses acting to expand the beam are schematically indicated as the force $F_T$ in FIG. 2. The vertical component of the resulting stress is then:

$$Eh\left(\alpha T-\frac{1}{2}\left(\frac{\partial u}{\partial x}\right)^2\right)\frac{\partial u}{\partial x}. \tag{11}$$

When microbeams are made, the manufacturing process may result in some intrinsic strain in the beam which adds an additional term to the above expression. To further analyze snap-through thermal actuator behavior, the concept of a rest shape, v(x), is introduced to describe a residual bowed shape at t=0 that the beam must have to practice the present inventions. A residual bowed shape may arise from mismatched internal stresses among layers of a beam constructed of multiple layers. Alternatively, a residual bowed shape may be formed by molding the beam over a depression or raised portion of a substrate and have no residual internal strains. Or, a combination of intentional residual strain and substrate molding techniques may be used to achieve a non-zero rest shape, v(x).

The quantity (u−v) is substituted in Equations 1–11 to express the change in shape of the microbeam as a function of time and spatial co-ordinate along the length of the beam. Therefore, the full mathematical model for small oscillations of the beam, including residual strain and a rest shape v(x), is:

$$\rho h\frac{\partial^2 u}{\partial t^2}+\frac{Eh^3}{12(1-\sigma^2)}\frac{\partial^4(u-v)}{\partial x^4}+Eh\frac{\partial}{\partial x}\left\{\left[\alpha T-s+\frac{1}{2}\left(\frac{\partial v}{\partial x}\right)^2-\frac{1}{2}\left(\frac{\partial u}{\partial x}\right)^2\right]\frac{\partial u}{\partial x}\right\}=0 \tag{12}$$

Residual fabrication induced strain in the microbeam, if any, is accounted for by the additional term s in Equation 12. The boundary conditions which complete the model are as follows:

$$u|_{t=0}=f(x); \tag{13}$$

$$u|_{x=\mp L/2}=v|_{x=\mp L/2}=0; \tag{14}$$

$$\left.\frac{\partial u}{\partial t}\right|_{t=0}=0;\ \text{and} \tag{15}$$

$$\left.\frac{\partial^2(u-v)}{\partial x^2}\right|_{x=\mp L/2}=\pm k\left.\frac{\partial(u-v)}{\partial x}\right|_{x=\mp L/2}-cT(t)-r. \tag{16}$$

Residual stresses may produce moments at the anchor connections and are accounted for by the term r in boundary condition Equation 16. The constant k in Equation 16 is the coefficient of proportionality for the counter moment that the anchoring attachment structure exerts in resisting the thermal moment, −cT(t), and the residual strain moment, r.

The standard analysis of a beam clamped at two ends usually specifies the anchoring connection of the beam to the support to be either rigid or hinged. A rigid or clamped connection holds the beam from moving laterally, along the x-direction in FIG. 2, and from rotating up or down at the connection point. A standard method of mathematically characterizing a physically rigid connection is to require that the slope, the first derivative with respect to x, of the beam be zero at the connection point for all times. This condition is equivalent to setting the proportionality constant k, in Equation 16, equal to infinity; that is, k→∞.

Alternatively, a hinged or pinned support constrains the beam from moving laterally but allows it to rotate vertically. Mathematically, a hinged connection is characterized by requiring that the second derivative of the beam deflection be zero at the connection point for all times. This condition is equivalent to setting the proportionality constant k in Equation 16 equal to zero, that is, k→0.

The standard physical connections, rigid or hinged, must be generalized in order to understand the snap-through actuation of the present inventions, as is illustrated in FIG. 1. In order for the internal thermo-mechanical mechanisms to pull the deformed element from a pre-biased downward buckling (see FIG. 1*b*), snapping through the zero deflection plane (see FIG. 1*c*), and over to a buckled-up state (see FIG. 1*d*), the supporting connections must allow some change in slope of the beam. Therefore the connection of the microbeam cannot be rigid. A connection which is intermediate to rigid or hinged is termed a semi-rigid connection or alternatively, a spring-hinged connection.

In a semi-rigid connection the anchoring edge material, a material in the joint, a portion of the deformable element, or a combination of such factors, resistingly yields to torque applied at the connection. The semi-rigid connection behaves as if it is a hinge with a stiff spring added to oppose the rotation of the movable part of the hinge. A connection or joint will behave as a semi-rigid connection if the joint resistance to an applied torque has a stiffness that is substantially higher than the stiffness of the beam being connected. If the joint resistance is infinite the connection is rigid, constraining the slope of the beam to be always zero. If the joint resistance is zero then the connection is hinged and the beam may be freely rotated by an applied torque.

For the purpose of the present inventions, the connection of deformable element 20 to opposing anchor edges 14 is preferably semi-rigid with a joint resistance in a stiffness range that sufficiently constrains the deformable element at its connection points against rotation so that, when initially heated, the deformable element bows farther outward in the direction of a residual shape bow. However the joint stiffness must be low enough that the connection allows an internal thermo-mechanical moment to rotate the beam in an opposite direction as the temperature increases to a substantially elevated value, resulting in the snap-through actuation illustrated in FIG. 1.

The present inventions require that an internal thermo-mechanical force be generated which acts against the pre-biased direction of the expansion buckling that occurs as the temperature of the deformed element increases. The required force is accomplished by designing an inhomogeneous structure, typically a planar laminate, comprised of materials having different thermo-mechanical properties, and especially substantially different coefficients of thermal expansion. For the bilayer element illustrated in FIGS. 1 and 2, a significant thermal moment, cT, will occur at an elevated temperature, T, if the coefficients of thermal expansion of the first layer 22 and the second layer 24 are substantially different while their respective values of Young's modulus are similar.

The thermal moment acts to bend the structure into an equilibrium shape in which the layer with the larger coefficient of thermal expansion is on the outside of the bend. Therefore, if second layer 24 has a coefficient of thermal expansion significantly larger than that of first layer 22, the thermal moment will act to bend the deformable element 20 upward in FIGS. 1 and 2. The thermal moment is schematically illustrated by the rotating torque, $T_{TM}$, in FIG. 2. The anchor connection, if non-rigid, resists the thermal moment torque with opposing anchor torque, $T_A$, also indicated schematically in FIG. 2.

The thermal moment coefficient c of a two-dimensional laminate structure may be found from the materials properties and thickness values of the layers which comprise the laminate:

$$c = \frac{\sum_j \frac{1}{2}(y_j^2 - y_{j-1}^2)(\alpha - \alpha_j)\frac{E}{1-\sigma_j^2}}{\sum_j \frac{1}{3}[(y_j - y_c)^3 - (y_{j-1} - y_c)^3]\frac{E}{1-\sigma_j^2}}, \tag{17}$$

where $y_c$ is given in above Equation 7.

For the purposes of the present invention, the beam will take on various shapes as it is made to cycle through a time-dependent temperature cycle, T(t), designed to cause snap-through motion as illustrated in FIG. 1. To further the analysis, let u(x,0)=f(x) at a thermal equilibrium. That is, let f(x) be the equilibrium, non-time-varying shape of the beam at a given temperature, T. f(x) must be computed as a solution to the equations developed heretofore. It is neither f(x)≡0 nor, necessarily, f(x)≡v(x). If there is no residual fabrication stress, then s=0, r=0, and, in this situation f(x)=v(x) at T=0.

The mathematical analysis is most straightforward for the case where a residual bowing shape is achieved in the microbeam by forming it without residual fabrication stresses. For example, the microbeam may be molded over a depression or a raised area using stress-free fabrication methods. In this case, s is set equal to zero in Equation 12, s=0; and r is set equal to zero in Equation 16, r=0. For this case of no residual strain, Equation 12 is recast in terms of equilibrium shape f(x) at a fixed temperature T, yielding the following differential equation and set of boundary conditions:

$$\frac{Eh^3}{12(1-\sigma^2)}\frac{\partial^4(f-v)}{\partial x^4} + Eh\frac{\partial}{\partial x}\left\{\left[\alpha T + \frac{1}{2}\left(\frac{\partial v}{\partial x}\right)^2 - \frac{1}{2}\left(\frac{\partial f}{\partial x}\right)^2\right]\frac{\partial f}{\partial x}\right\} = 0. \tag{18}$$

$$f|_{x\mp L/2} = v|_{x=\mp L/2} = 0 \text{ and} \tag{19}$$

$$\left.\frac{\partial^2(f-v)}{\partial x^2}\right|_{x=\mp L/2} = \pm k\left.\frac{\partial(f-v)}{\partial x}\right|_{x=\mp L/2} - cT. \tag{20}$$

Boundary condition Equation 20 accounts for the non-rigid connection structures and for the thermally induced torque which acts at the anchor point, according to the present inventions. The constant k expresses the stiffness of the non-rigid connection. A semi-rigid connection becomes a rigid connection as kΔ∞ and a hinged connection as k→0. The semi-rigid connection generates a counter moment, $T_A$, to the thermal moment. $T_{TM}$, which is proportional to the slope of the beam at the connection point. In FIG. 2, the microbeam slope is indicated by a small angle Θ, which is equivalent to $$\frac{\partial f}{\partial x}$$

when expressed in radians and the amount of microbeam slope is very small, as it will be for practical embodiments of the present inventions.

The constant k is dependent on the materials properties and design parameters of the opposing anchor edges, the materials properties and geometrical parameters of the deformable element, and any other materials, such as adhesives, that are present at the semi-rigid connection. For some simple designs using materials having accurately known materials parameters, it may be possible to calculate k by solving a complicated boundary-value problem for the full elasticity equations. However, for the purpose of the present inventions the design of the deformable element anchor connection is determined experimentally and the parameter k is treated as a fitting parameter in analyzing the resulting motion of the supported deformable element.

The parameters of the semi-rigid connection may be determined by systematically varying relevant geometrical parameters or material's properties and observing the effectiveness of snap-through actuation. The stiffness of the semi-rigid connection is preferably sufficient to constrain the deformable element so that there is substantial initial buckling in the direction of the residual bowed shape, i.e. downward in FIGS. 1 and 2. However the stiffness cannot be so great that the thermal moment cannot act to rotate the deformable element upward at the semi-rigid connection thereby triggering the snap-through motion which is the basis of the present inventions. There are practical limits on the magnitude of the thermal moment that can be achieved within the constraints of available materials and reliable peak temperature operation. A standard microelectronic beam connection design is likely to be too stiff to allow the desired snap-through behavior. Some approaches to the experimental development of an semi-rigid connection appropriate to the present inventions will be discussed hereinbelow.

A mean-field approximation may be employed to the non-linear terms in Equation 18 in order to obtain analytic results. Alternatively, numerical computational methods may be used to solve Equation 18 without making this approximation. This latter approach will be taken hereinbelow to generate a time-variable simulation of snap-through and standard buckling of a microbeam deformable element. For the mean-field analytic approximation the following parameter $\mu$ is defined:

$$\mu = \frac{1}{L}\int_{-L/2}^{L/2}\left[\frac{1}{2}\left(\frac{\partial f}{\partial x}\right)^2 - \frac{1}{2}\left(\frac{\partial v}{\partial x}\right)^2\right]dx. \tag{21}$$

When the meanfield approximation of Equation 21 is used with the partial differential Equation 18, and an equilibrium (quiescent) solution is considered, the following simplified expression is obtained:

$$\frac{\partial^4 f}{\partial x^4} + \frac{12(1-\sigma^2)}{h^2}(\alpha T - \mu)\frac{\partial^2 f}{\partial x^2} = \frac{\partial^4 v}{\partial x^4}. \tag{22}$$

Two different residual shapes are compared:

$$v(x)=0 \text{ and } v(x)=\delta\cos(\pi x/L) \tag{23}$$

For v(x)=0 there is no residual bowing of the deformable element. Alternatively, the cosine shape given in Equation 23 bows outward at the center, x=0 and is zero, i.e. fixed, at either end x=±L/2. For the microbeam deformable element illustrated in FIG. 1*a*, δ is negative. It should be understood that the cosine shape being considered is not exactly the expected residual shape for a physical microbeam deformable element. The cosine function given in Equation 23 may be considered as the first term in a Fourier series representation which sufficiently represents the true physical shape for the purposes of this approximate analysis of the snap-through thermal actuator.

Equation 22 is solved for the two residual shapes of Equation 23 while also satisfying the boundary conditions given in Equations 19 and 20. For the non-zero cosine function shape, the following function for $f(x)$ is an equilibrium (quiescent) solution to the mean-field approximation, Equation 21:

$$f(x) = A[\cos(\beta L/2) - \cos(\beta x)] + \frac{\delta\pi^2}{\pi^2 - \beta^2 L^2}\cos(\pi x/L), \tag{24}$$

$$\text{where } \beta = \pm\sqrt{\frac{12(1-\sigma^2)}{h^2}(\alpha T - \mu)}. \tag{25}$$

An expression for the amplitude A can be obtained from the semi-rigid connection boundary condition, Equation 20 to be:

$$A = \frac{-cT - k\delta\frac{\pi}{L} + \frac{k\pi^3\delta}{L(\pi^2 - \beta^2 L^2)}}{\beta^2\cos\left(\beta\frac{L}{2}\right) + k\beta\sin\left(\beta\frac{L}{2}\right)}. \tag{26}$$

A second expression for the amplitude A can be obtained by carrying out the meanfield approximation integral, Equation 21, to compute $\mu$, and then equating $\mu$ to the value of $\mu$ expressed as a function of β given in Equation 25. This procedure results in a quadratic expression for A in terms of β:

$$\frac{\beta^2}{4}\left[1 - \frac{\sin(\beta L)}{\beta L}\right]A^2 - \frac{k\pi^3\delta}{L(\pi^2 - \beta^2 L^2)}\cos\left(\beta\frac{L}{2}\right)A + \frac{\delta^2\pi^2}{4L^2}\left[\frac{\pi^4}{(\pi^2 - \beta^2 L^2)} - 1\right] - \left[\alpha T - \frac{h^2\beta^2}{12(1-\sigma^2)}\right] = 0. \tag{27}$$

At a given temperature, quadratic Equation 27 yields two expressions for A in terms of β. By substituting the expression for A found in Equation 26 into each of these expressions, two equations for β are obtained.

Figure 3:
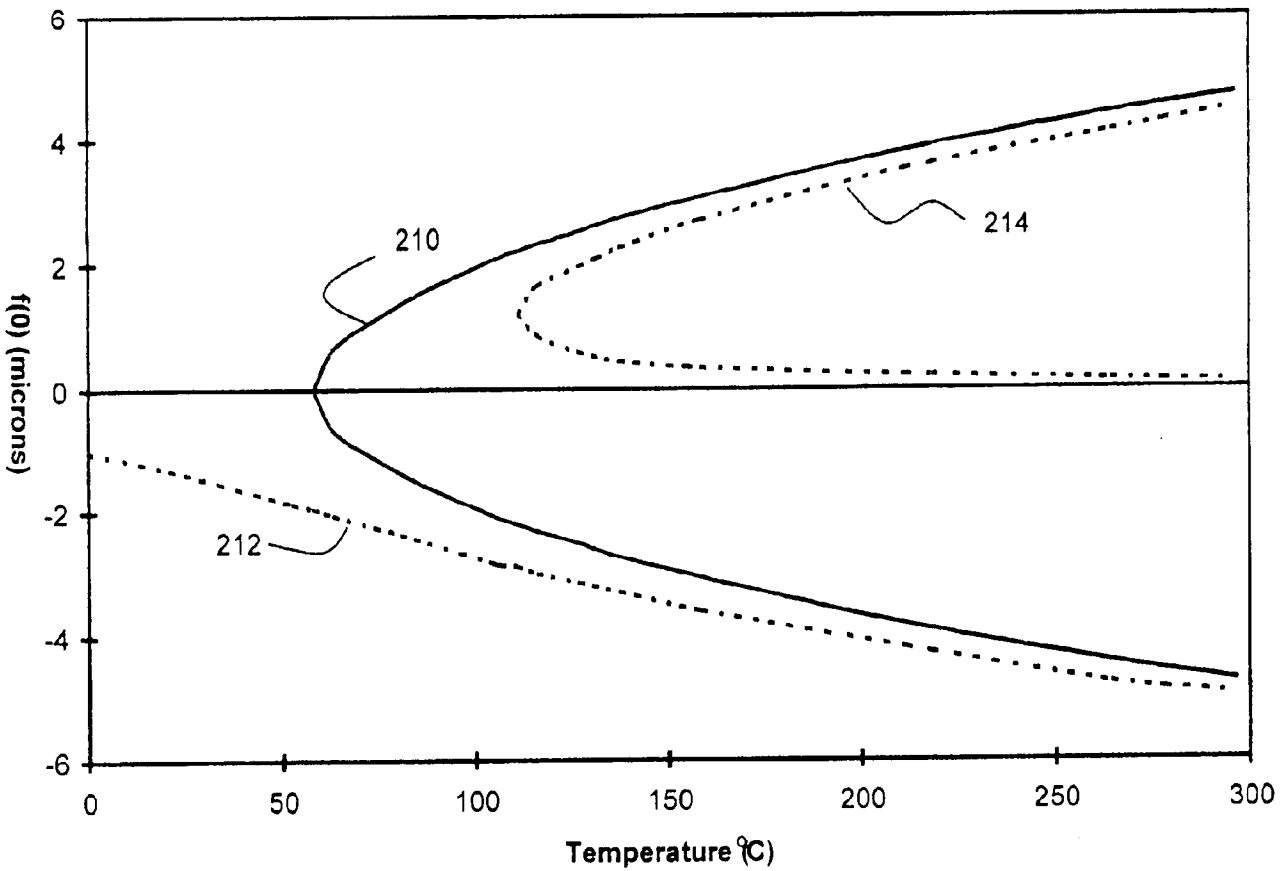
FIG. 3 is a theoretical calculation of the equilibrium displacement of a deformable element having rigid anchoring connections as a function of temperature.

In FIG. 3 the equilibrium displacement at the center of the beam is compared for two different residual shapes: flat (v(x)=0) and concave (v(x)=δ cos (πx/L)) computed from solutions for A and β from Equations 26 and 27 and evaluated in Equation 24. FIG. 3 shows the displacement $f(0)$ as a function of temperature, T, when the connection of the microbeam deformable element 20 to the opposing anchor edges 14 is rigid, unyielding. This condition is found by making k→∞ in Equations 26 and 27.

For the computations leading to the plots of FIG. 3, and FIGS. 4 and 5 hereinbelow as well, the following effective physical parameters were used: $E=1.78>10^{12}$ dynes/cm$^2$; h=2 μm; L=200 μm; ρ=3.2 g/cm$^3$, σ=0.25; $\alpha=7.32\times10^{-6}$. The thermal moment coefficient, c, is calculated via Equations 17 and 7 from the individual properties of the first layer 22 and the second layer 24. A value of c=−9.92 cm$^{-2}$ °C$^{-1}$ was used for the computations of FIGS. 3–5, arising from layers having: $h_1$=1.2 μm, $h_2$=0.8 μm, $\alpha_1=1.55\times10^{-6}$, $\alpha_2=1.52\times10^{-5}$, $E_1=1.87\times10^{12}$, $E_2=1.7\times10^2$, $\sigma_1=\sigma_2=0.25$.

Curve 210 in FIG. 3 shows the equilibrium displacement for a flat residual shape, δ=0. Curves 212 and 214 in FIG. 3 shows the two solutions arising from the quadratic Equation 27 in the case of a cosine residual shape with an amplitude δ=−1 μm. In the flat case (curve 210), the equilibrium solution of the beam bifurcates from a single, stable equilibrium to a bistable equilibrium, once the critical temperature, $T_c$, is reached. The critical temperature, $T_c$ is the temperature that produces a thermal strain sufficient to induce a stress equal to the Euler load at which point the beam buckles, either up or down, with an amplitude proportional to the square root of the temperature above $T_c$, i.e. $f(0)\propto(T-T_c)^{1/2}$. The critical temperature, $T_c$, is given by:

$$T_c = \frac{h^2}{12\alpha(1-\sigma^2)}\left(\frac{2\pi}{L}\right)^2. \tag{28}$$

For the cosine residual shape case, curves 212 and 214 show the solutions to the two solution branches arising from the quadratic Equation 27. The microbeam deformable element will follow the lower curve with increasing temperature, beginning with a deflection of −1 μm and then monotonically buckling farther outward in negative direction with increasing temperature. For this case of a rigid connection, k→∞, the thermal moment term has no effect. This can also be seen from the expression for the amplitude A given in Equation 26. It can be seen that as k→∞ the thermal moment term −cT has no effect on the value of the amplitude A.

From this analysis it can be understood that the microbeam deflectable element 20 will not spontaneously transition from buckled-down to buckle-up, snapping through the central plane, for a rigid connection at the opposing anchor edges. An external force must be applied to the microbeam to push it from following curve 212 in FIG. 3 to moving along curve 214. An important characteristic of the present inventions is the use of a non-rigid or semi-rigid, connections for attaching the deformable element to the opposing anchor edges so that the internal thermal moment can cause the snap-through actuation without need of an external force.

Figure 4:
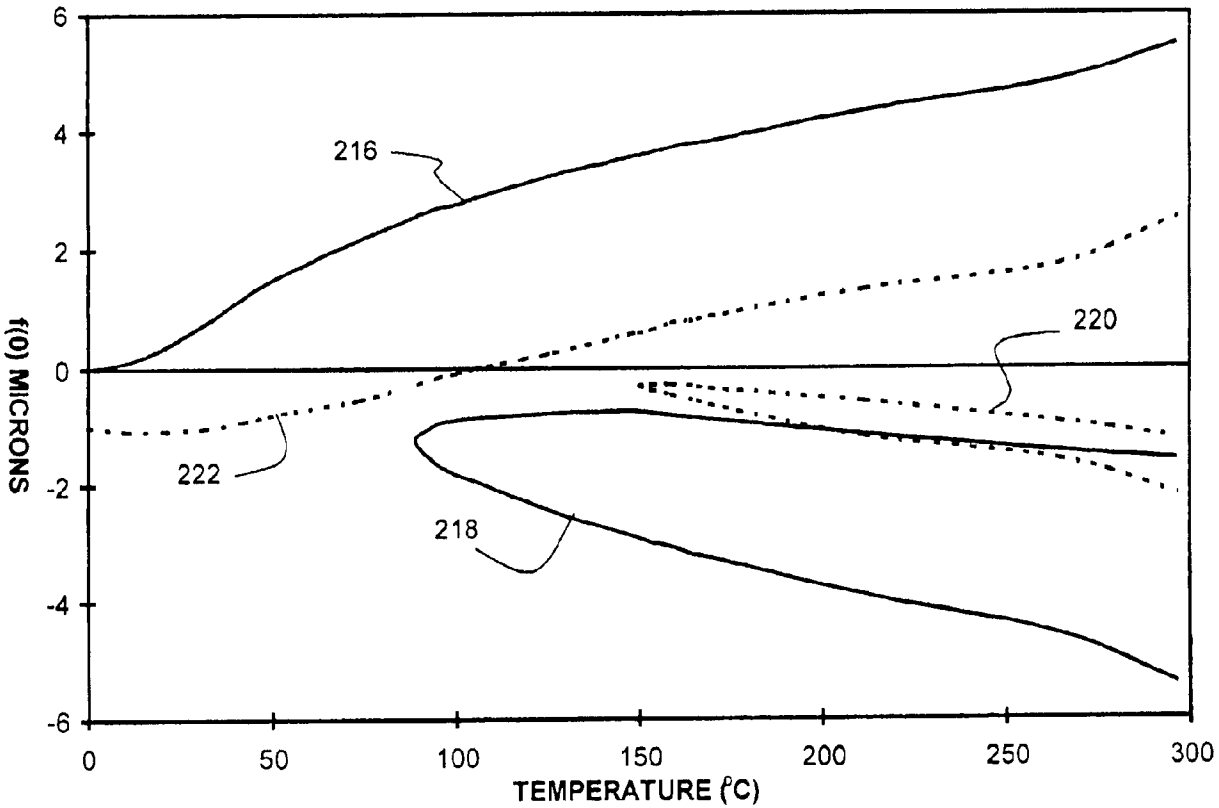
FIG. 4 is a theoretical calculation of the equilibrium displacement of a deformable element having semi-rigid anchoring connections as a function of temperature.

FIG. 4 illustrates a set of calculations for the deflection of a microbeam attached using semi-rigid connections, k=500 $cm^{-1}$, with increasing temperature, for the cases of a flat and a cosine residual shape, wherein $\delta=0$ and $-1$ $\mu$m respectively. Curves 216 and 218 show the two solutions arising from quadratic Equation 27 for the case of $\delta=0$. Curves 222 and 220 show the two solutions for the cosine residual shape with $\delta=-1$ $\mu$m. For the semi-rigid connection configurations analyzed in FIG. 4, the thermal moment term, $-cT$, does importantly affect the behavior of the microbeam deformable element. The $\delta=0$ case, curves 216 and 218, shows that the microbeam immediately deflects upward, i.e. positive $f(0)$, as soon as the temperature is raised, because the thermal moment forces the buckling in that direction. As above, the buckling can be caused to transition to the opposite side, downward to curve 218, only by applying and external force.

For the case wherein there is an initial residual shape of bowing away from the direction of the thermal moment action, i.e. $f(0)=-1$ $\mu$m at T=0 (the ambient operating temperature is normalized to zero for the calculation), the deformation is seen to cross over from buckled-down to buckled-up, at ~100° C. above ambient in the computed example of FIG. 4. While the curves of FIG. 4 are equilibrium cases, i.e. quiescent calculations, they illustrate the critical role of a non-rigid connection, $k<\infty$, in allowing the internally generated thermal moment to force the microbeam deformable element from a buckled-down to a buckled-up state. This transition is necessary for the snap-through actuation which is the basis for the improved performance of the actuators of present inventions over simple buckling in a pre-biased direction. Improved performance results from the release of stored elastic energy as the deformable element makes the snap-through transition.

The results of solving Equations 18–20, plotted in FIGS. 3 and 4, apply for the cases of microbeams having residual bow without residual strain. The mathematical analysis of a residually bowed microbeam is considerably more convoluted for the case of non-zero residual strain, s, and strain induced moment, r. However, the behavior of a residually stressed and bowed microbeam will be similar to that indicated by the above analysis and by the plots in FIGS. 3 and 4. The equilibrium behavior of a residually bowed microbeam, subject to a thermal moment, is substantially conveyed by FIGS. 3 and 4 irrespective of the fabrication technique that creates the residual bowed shape.

In order to calculate the time dependent motions of the thermo-mechanical devices of the present inventions, the full nonlinear initial boundary value problem, Equations 12–16, are solved numerically. For this numerical calculation the method of lines may be used to discretize the partial differential equation spatially. The resulting large set of ordinary differential equations may then be solved by a specialized software tool such as the solver DIVPAG from the International Mathematical Subroutine Library (IMSL). FIG. 5 shows the results for the deformation of the center of a microbeam deformable element, $f(0,t)$, curves 224 and 226, from such a numerical analysis of the Equations 12–16. Semi-rigid connections are used wherein k=500 $cm^{-1}$.

Figure 5:
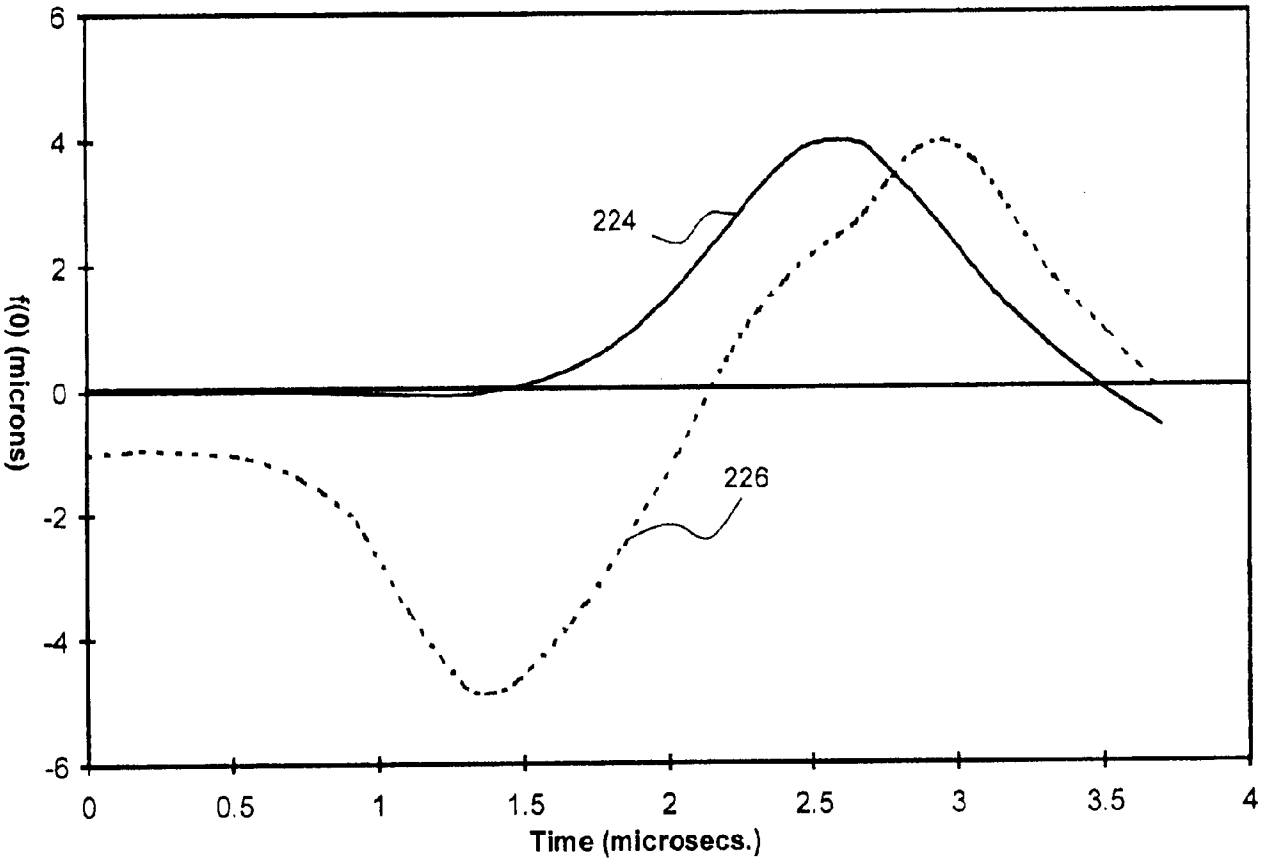
FIG. 5 is a theoretical calculation of the time-varying displacement of a deformable element having semi-rigid anchoring connections according to the present inventions.

FIG. 5 show the results of applying a heat pulse with a linear rise of 200° C. in 1 $\mu$s followed by an exponential decay. The heat pulse is applied to a microbeam deformable element that has a flat residual shape initially, $\delta=0$, resulting in curve 224. The physical parameters noted above with respect to the equilibrium calculations plotted in FIGS. 3 and 4 were used for the calculations plotted as curves 224 and 226 in FIG. 5. For the flat residual shape case, the microbeam deforms in a buckle-up direction, driven by the thermal moment, to a magnitude of ~4 $\mu$m. No snap-through behavior is indicated.

Curve 226 in FIG. 5 shows the calculational results for a non-flat, concave residual shape having a residual magnitude of deformation of $-1$ $\mu$m, when subjected to the same heat pulse that was applied to the flat residual shape deformable element, curve 224. As the non-flat shape is heated, it expands thermally, bending further downwards in the direction of the residual shape bowing, away from second layer 24. The thermal moment, generated by the differences in thermal expansion between first layer 22 and second layer 24, bend the microbeam upward until it snaps-through to buckle toward the opposite side, i.e. towards second layer 24. As this happens, the microbeam deformable element is significantly compressed, in order to squeeze through the interval in the central plane that is shorter than its rest length.

A considerable amount of energy is stored in the compression of the deformable element, energy that is released as kinetic energy when the microbeam deformable element snaps through and emerges on the opposite side of the central plane. Comparing curves 224 and 226 in FIG. 5 it can be seen that the snap-through actuation exhibited (curve 226) shows a doubling of the peak-to-peak amplitude of displacement and an increase in the speed by ~1.6. This significantly improved total magnitude of deformation and increased speed of the physical transition of the deformable element is the basis of the substantially enhanced performance of snap-through thermal actuators according to the present inventions. Three elements are important to achieving the snap-through actuation of the present inventions: non-rigid or semi-rigid connections of the deformable element to the opposing anchor edges, a substantial thermal moment arising from the composition of the deformable element, and a residual shape which is bowed away from the direction in which the thermal moment will force the deformable element upon the application of a heat pulse.

The snap-through thermal actuator of the present inventions is useful for many applications wherein forceful, impulsive mechanical actuation is needed or beneficial. Apparatus for liquid drop emission, metering and fluid valving are especially appropriate systems whose performance can be improved by use of snap-through thermal actuators according to the present inventions. Reproducible drop formation, using a minimum of energy per drop is enhanced if the pressure impulse, force over time, is intense. Liquids with large viscosities may be accommodated if large pressure impulses can be generated.

Binary fluid valving performance is also enhanced by the same characteristics. Binary microvalves are needed to gate liquid and gas flows for a variety of emerging fluid-handling micro systems. A snap-through thermal actuated valve according to the present inventions can perform the on/off switching function quickly and forcefully, minimizing the period and amount of indeterminate fluid flow, i.e. improving the accuracy and incremental fineness of the control of the fluid involved.

Binary electrical microswitching performance may be enhanced by the characteristics of the snap-through thermal actuators of the present inventions as well. A snap-through thermal actuated microswitch according to the present inventions can perform the on/off switching function quickly and forcefully, minimizing the period of indeterminate electrical states in a switched circuit. Microswitches according to the present inventions can improve the incremental fineness of the control of electrical levels or of measured time periods.

Figure 6:
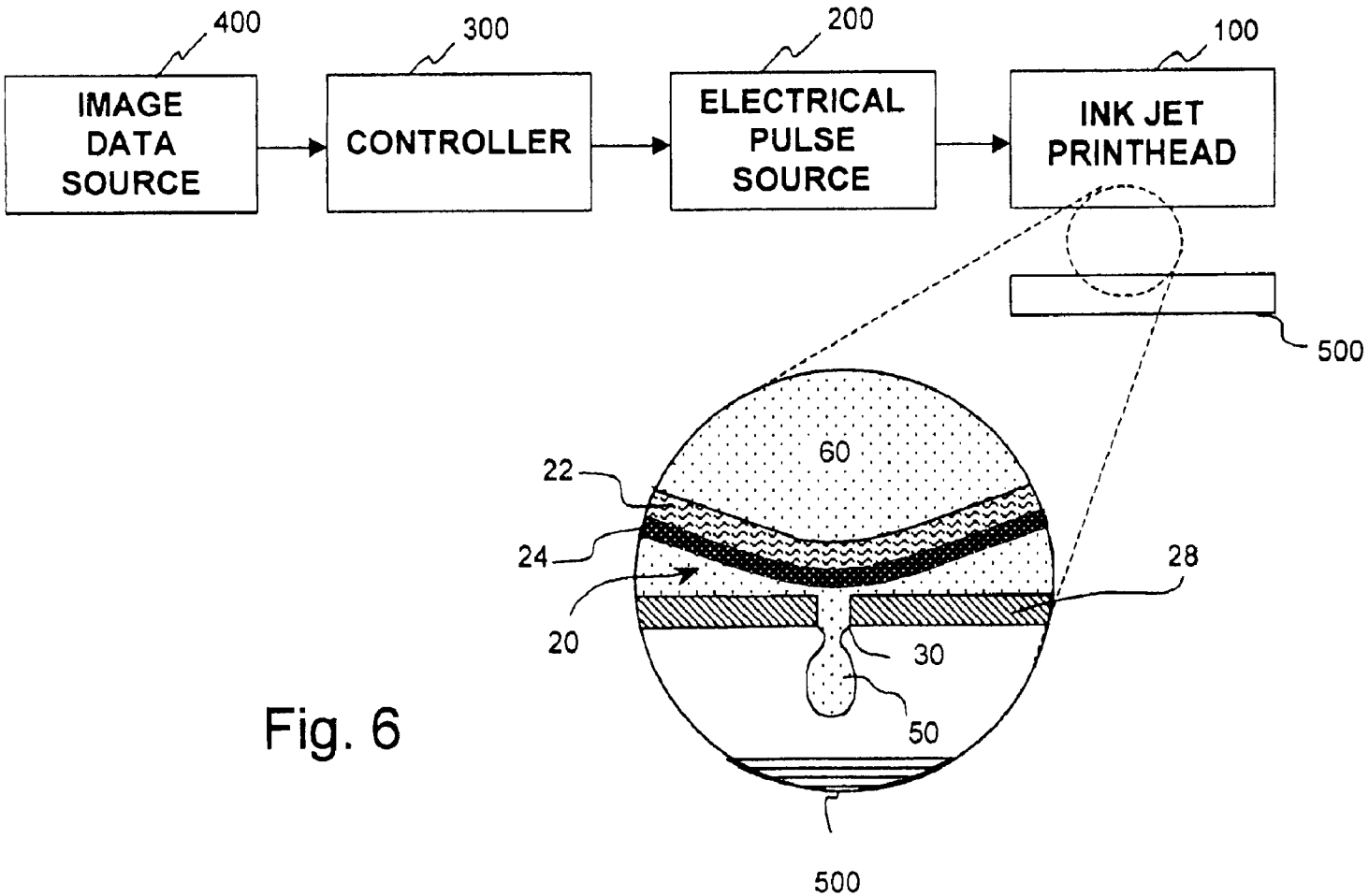
FIG. 6 is a schematic illustration of an ink jet system according to the present invention.

Turning now to FIG. 6, there is shown a schematic representation of an ink jet printing system which may use an apparatus according to the present inventions. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each snap-through thermal actuator 15 within ink jet printhead 100. The electrical energy pulses cause a snap-through thermal actuator 15 to rapidly deform, pressurizing ink 60 located at nozzle 30, and emitting an ink drop 50 which lands on receiver 500.

The present invention causes the emission of drops having substantially the same volume and velocity, that is, having volume and velocity within ±20% of a nominal value. Some drop emitters may emit a main drop and very small trailing drops, termed satellite drops. The present invention assumes that such satellite drops are considered part of the main drop emitted in serving the overall application purpose, e.g., for printing an image pixel or for micro dispensing an increment of fluid.

Figure 7:
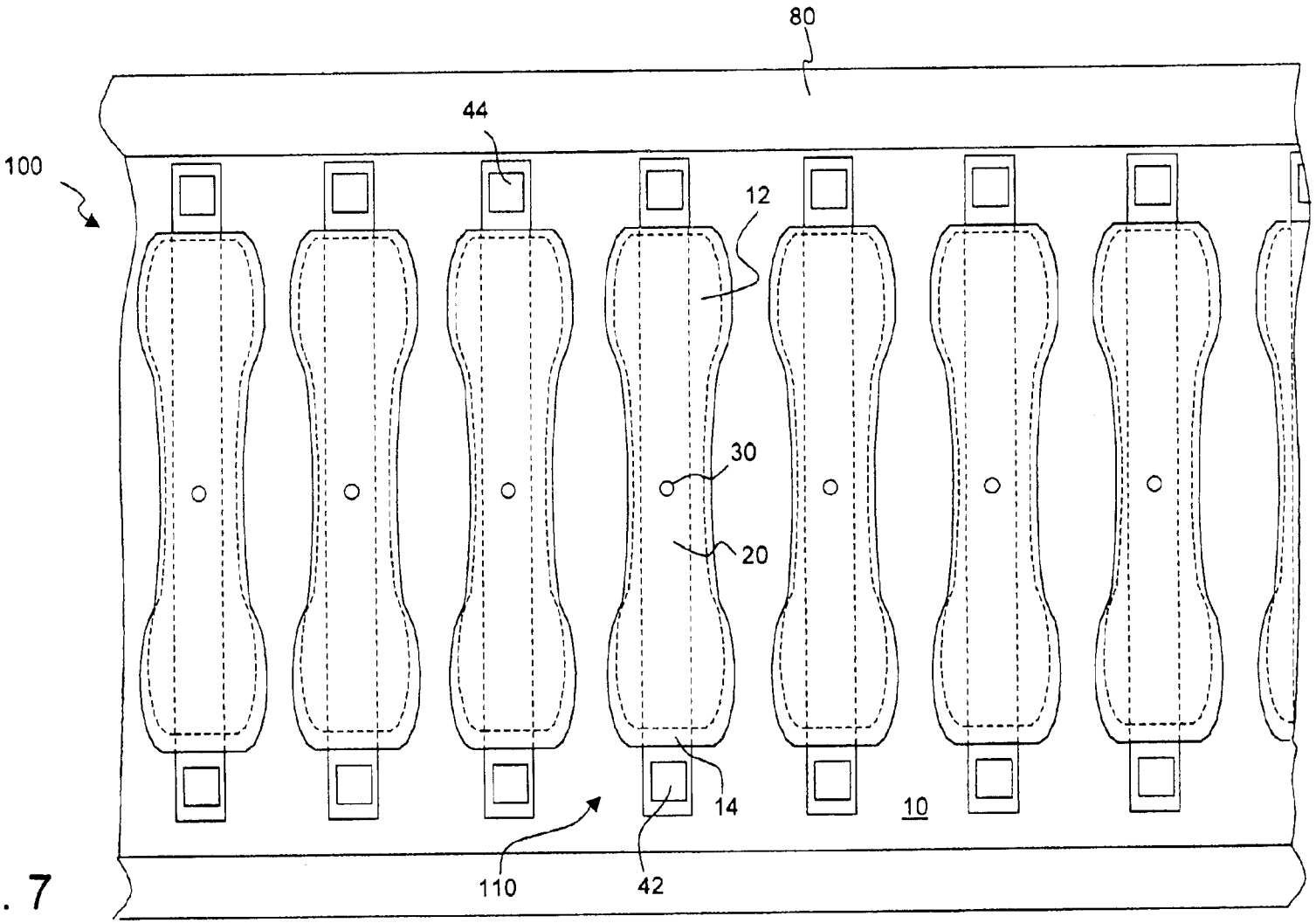
FIG. 7 is a plan view of an array of ink jet units or liquid drop emitter units according to the present invention.

FIG. 7 shows a plan view of a portion of ink jet printhead 100. An array of thermally actuated ink jet units 110 is shown having nozzles 30 centrally aligned, and ink chambers 12. The ink jet units 110 are formed on and in a substrate 10 using microelectronic fabrication methods.

Each drop emitter unit 110 has associated electrical heater electrode contacts 42, 44 which are formed with, or are electrically connected to, an electrically resistive heater which is formed in a second layer of the deformable element 20 of a snap-through thermal actuator and participates in the thermo-mechanical effects as will be described. The electrical resistor in this embodiment is coincident with the second layer 24 of the deformable element 20 and is not visible separately in the plan views of FIG. 7. Element 80 of the printhead 100 is a mounting structure which provides a mounting surface for microelectronic substrate 10 and other means for interconnecting the liquid supply, electrical signals, and mechanical interface features.

Figure 8A:
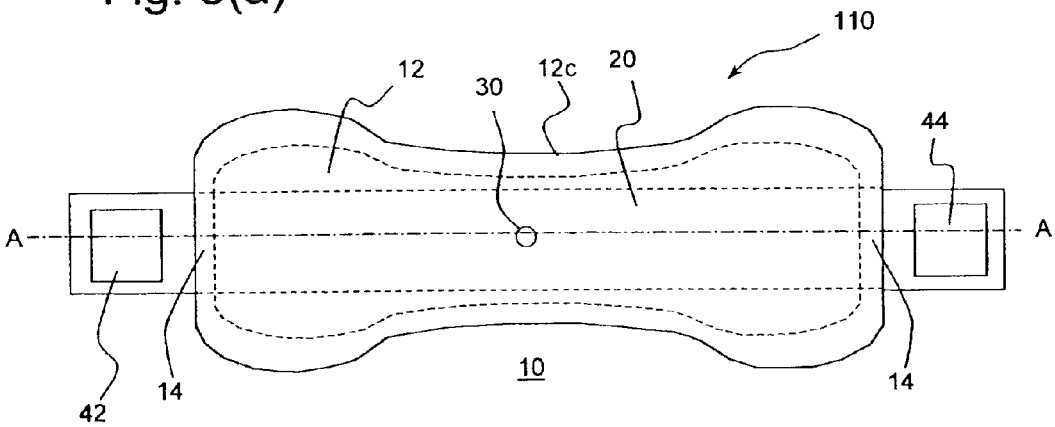
FIG. 8 is an enlarged plan view of an individual ink jet unit shown in FIG. 7.
Figure 8B:
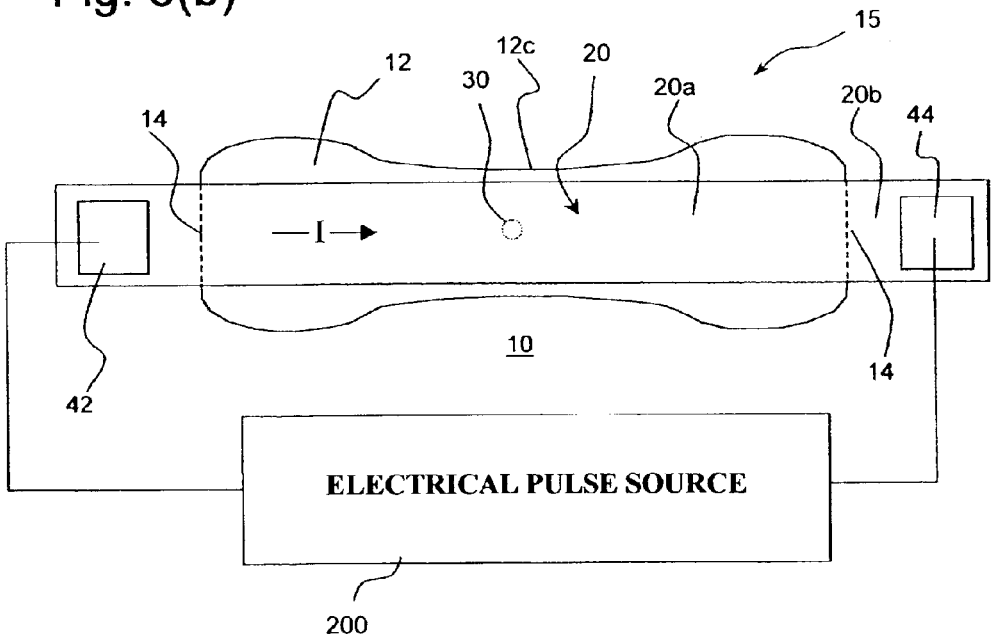

FIG. 8*a* illustrates a plan view of a single drop emitter unit 110 and a second plan view FIG. 8*b* with the liquid chamber cover 28, including nozzle 30, removed.

The snap-through thermal actuator 15, shown in phantom in FIG. 8*a* can be seen with solid lines in FIG. 8*b*. The deformable element 20 of snap-through thermal actuator 15 extends from opposing anchor edges 14 of liquid chamber 12 which is formed as a depression in substrate 10. Deformable element anchor portion 20*b* is bonded to substrate 10 and anchors the deformable element 20.

The deformable element 20 of the actuator has the shape of a long, thin and wide beam. This shape is merely illustrative of deformable elements for snap-through thermal actuators which can be used. Many other shapes are applicable. For some embodiments of the present invention the deformable element is a plate which is attached to the base element continuously around its perimeter.

In FIG. 8 the fluid chamber 12 has a narrowed wall portion at 12*c* which conforms to the central portion 20*a* of deformable element 20, spaced away to provide clearance for the actuator movement during snap-through deformation. The close positioning of the walls of chamber 12, where the maximum deformation of the snap-through actuator occurs, helps to concentrate the pressure impulse generated to efficiently affect liquid drop emission at the nozzle 30.

FIG. 8*b* illustrates schematically the attachment of electrical pulse source 200 to the electrically resistive heater (coincident with second layer 24 of deformable element 20) at heater electrodes 42 and 44. Voltage differences are applied to voltage terminals 42 and 44 to cause resistance heating via the resistor. This is generally indicated by an arrow showing a current I. In the plan views of FIG. 8, the central portion 20*a* of deformable element 20 moves toward the viewer when it is electrically pulsed and forcefully snaps-through its central plane. Drops are emitted toward the viewer from the nozzle 30 in cover 28. This geometry of actuation and drop emission is called a "roof shooter" in many ink jet disclosures.

Figure 9A:
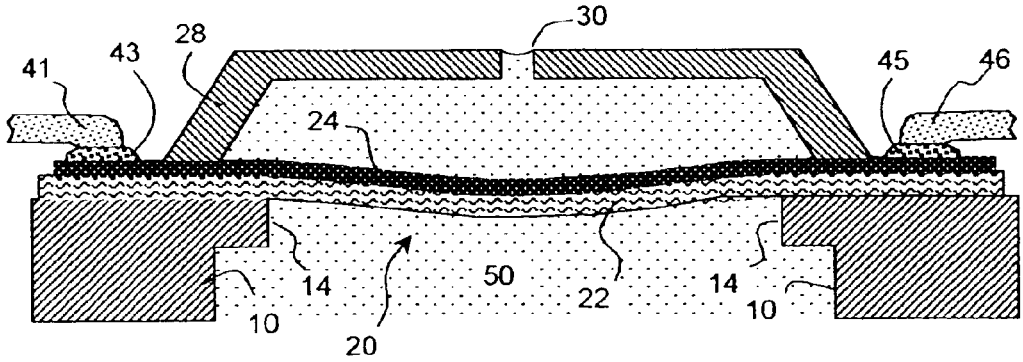
FIG. 9 is a side view illustrating the movement of a thermal actuator according to the present invention.
Figure 9B:
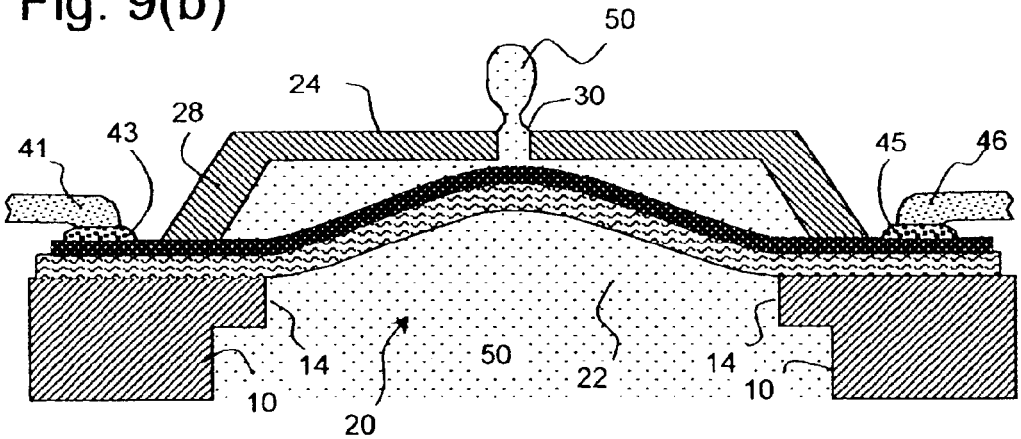

FIG. 9 illustrates in side view a snap-through thermal actuator according to a preferred embodiment of the present invention. In FIG. 9*a* the deformable element 20 is in a first quiescent position having a residual shape bowed downward away from second layer 24. FIG. 9*b* shows the deformable element buckled upward to a second position after undergoing snap-through transition through a central plane. Deformable element 20 is anchored to substrate 10 which serves as a base element for the snap-through thermal actuator. Deformable element 20 is attached to opposing anchor edges 14 of substrate base element 10 using materials and a configuration which results in semi-rigid connections, the importance of which was previously explained. In FIG. 9*a* portion of the base element 10 material has been removed immediately below opposing anchor edges 14 to render the structure at the attachment point somewhat flexible, i.e. semi-rigid.

Deformable element 20 is constructed of at least two layers. Second layer 24 is constructed of a second material having a large coefficient of thermal expansion to cause an upward thermal moment and subsequent snap-through buckling when it is thermally elongated with respect to other layers in the deformable element. First layer 22 is constructed of a material having a substantially smaller coefficient of thermal expansion than the material used to construct second layer 24. The thickness, Young's moduli, and coefficients of thermal expansion of at least first layer 22 and second layer 24 are selected to result in a thermal moment of substantial magnitude over a temperature range that is practical for the device materials and any working fluids involved.

Other layers may be included in the construction of deformable element 20. Additional material layers, or sublayers of first layer 22 and second layer 24, may be used for thermo-mechanical performance, electrical resistivity, dielectric insulation, chemical protection and passivation, adhesive strength, fabrication cost, light absorption or reflection and so on. A resultant thermo-mechanical behavior of the deformable element that is required, however constructed, is that a significant thermal moment be generated in the operating temperature range to be used in the application of the snap-through thermal actuator.

A heat pulse is applied to second layer 24, causing it to rise in temperature and elongate. Initially the elongation causes the deformable element to buckle farther in the direction of the residual shape bowing (downward in FIG. 9). First layer 22 also rises in temperature and elongates due to some thermal expansion but also in response to the stress applied by second layer 24. Substantial elastic energy is stored in the elongated layers of the deformable element. At a sufficiently high temperature, the thermal moment causes the deformable element 20 to reverse in a rapid snap-through transition resulting in a deformation, a buckling upward in a direction opposite to the residual shape bowing. The rapid snap-through transition produces a pressure impulse in the liquid at the nozzle 30, causing a drop 50 to be ejected.

When used as actuators in drop emitters the buckling response of the deformable element 20 must be rapid enough to sufficiently pressurize the liquid at the nozzle. Typically, electrically resistive heating apparatus is adapted to apply heat pulses and an electrical pulse duration of less than 10 $\mu$secs. is used and, preferably, a duration less than 2 $\mu$secs.

FIGS. 10 through 15 illustrate fabrication processing steps for constructing a single liquid drop emitter according to some of the preferred embodiments of the present invention. For these embodiments the second layer 24 is constructed using an electrically resistive material, such as titanium aluminide, and a portion is patterned into a resistor for carrying electrical current, I.

Figure 10:
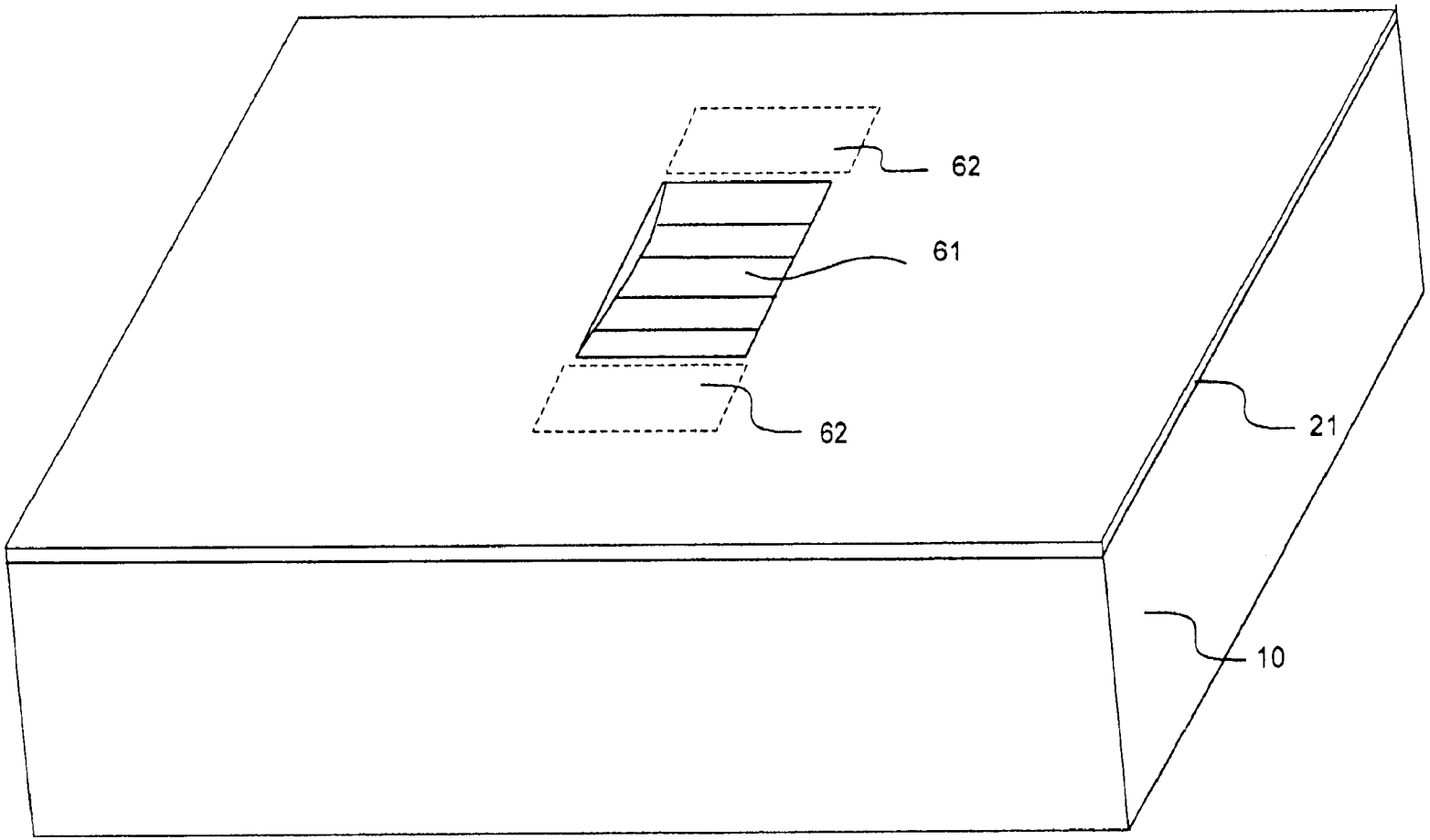
FIG. 10 is a perspective view of the first stages of a process suitable for constructing a snap-through thermal actuator according to the present invention wherein a substrate is prepared.

FIG. 10 illustrates a microelectronic material substrate 10, for example, single crystal silicon, in the initial stages of a microelectromechanical fabrication process sequence. In the illustrated fabrication sequence, substrate 10 becomes the base element 10 of a snap-through thermal actuator. A shallow central mold depression 61 is formed in mold layer 21, covering substrate 10. Mold depression 61 will serve in the fabrication process as a mold for the formation of a concave residual shape of a deformable element. Mold layer 21 may be a material such as an oxide, a nitride, a polysilicon or the like. Alternatively, a concave residual shape may be achieved by manipulation of residual strains in the layers of the deformable element, and mold depression 61 is not used.

In FIG. 10, two etch stop regions 62, denoted by phantom lines, are formed by a dopant implant process, such as diffusion or ion implantation. Etch stop regions 62 are positioned where the opposing anchor edges are to be formed and will resist a subsequent backside etch process which will open the liquid drop emitter to a fluid supply and release the deformable element so that it may buckle. The combination of the backside etch and the etch resistant regions results in a thin ledge of the substrate material forming base element 10 at the point of opposing anchor edges 14 (see FIG. 9), thereby contributing flexibility to the attachment of the deformable element 20 and the formation of a semi-rigid connection according to the present inventions. The stiffness of the semi-rigid connection may be explored experimentally by creating a series of devices having different relief portions of substrate material removed beneath the opposing anchor edges. Snap-through transition behavior may then be observed versus joint stiffness to identify an optimal design for a specific device application.

Figure 11:
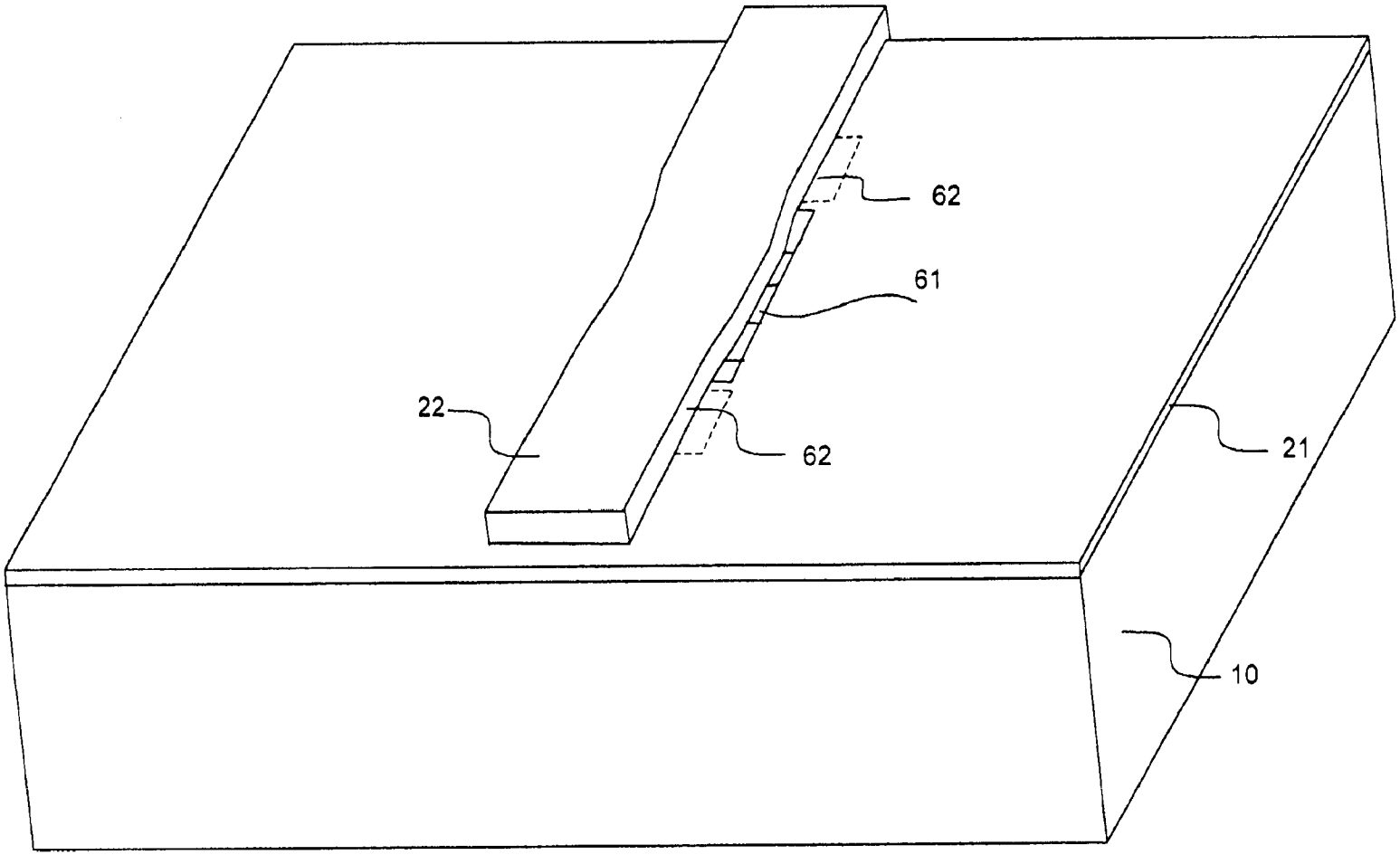
FIG. 11 is a perspective view of the next stages of the process illustrated in FIG. 10 wherein a first layer of the deformable element is formed.

FIG. 11 illustrates a first layer 22 of a future deformable element having been deposited and patterned over the previously prepared substrate, conforming to the shape of mold depression 61. A first material used for first layer 22 has a low coefficient of thermal expansion and a relatively high Young's modulus. Typical materials suitable for first layer 22 are oxides or nitrides of silicon. However, many microelectronic materials will serve the first layer 22 function of helping to generate a strong thermal moment and storing elastic energy when strained. For many microactuator device applications, first layer 22 will be a few microns in thickness.

Figure 12:
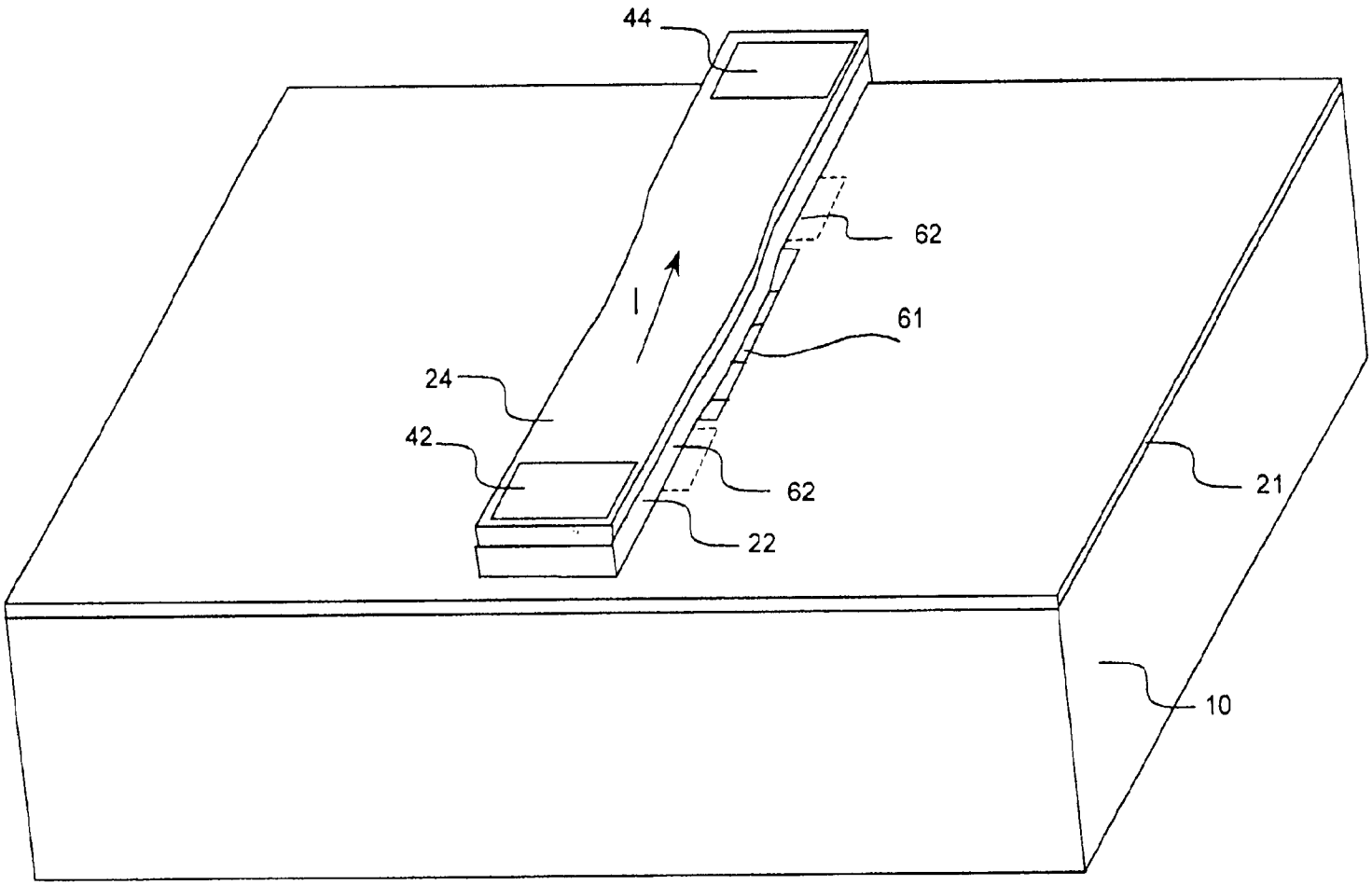
FIG. 12 is a perspective view of the next stages of the process illustrated in FIGS. 10–11 wherein a second layer of the deformable element is formed.

FIG. 12 illustrates the formation of second layer 24 of a future deformable element overlaying first layer 22. Second layer 24 is constructed of a second material having a large coefficient of thermal expansion, such as a metal. In order to generate a large thermal moment and to maximize the storage of elastic energy for snap-through actuation, it is preferable that the second material have a Young's modulus that is comparable to that of the first material. A preferred second material for the present inventions is intermetallic titanium aluminide. For the embodiments of the present inventions illustrated in FIGS. 10–15, second layer 24 is also electrically resistive and is formed with a resistor pattern. Application of electrical pulses via addressing heater electrodes 42 and 44 cause a heat pulse to be applied to the deformable element.

Deposition of intermetallic titanium aluminide may be carried out, for example, by RF or pulsed DC magnetron sputtering. A resistor is coincidentally formed in second layer 24. The current path is indicated by an arrow and letter "I". Addressing heater electrodes 42 and 44 are illustrated as being formed in the second layer 24 material. Heater electrodes 42, 44 may make contact with circuitry previously formed in substrate 10 passing through vias in first layer 22 (not shown in FIG. 11) or may be contacted externally by other standard electrical interconnection methods, such as tape automated bonding (TAB) or wire bonding.

Alternate embodiments of the present inventions utilize an additional electrical resistor element to apply heat pulses to the deformable element. In this case such an element may be constructed as one of more additional laminations positioned between first layer 22 and second layer 24 or above second layer 24. Application of the heating pulse directly to the thermally expanding layer, second layer 24, is beneficial in promoting the maximum thermal moment by maximizing the thermal expansion differential between second layer 24 and first layer 22. However, because additional laminations comprising the electrical resistor heater element will contribute to the overall thermo-mechanical behavior of the deformable element, the most favorable positioning of these laminations, above or below second layer 24, will depend on the mechanical properties of the additional layers, Additional passivation materials may be applied at this stage over second layer 24 for chemical and electrical protection. Additional chemical passivation may be beneficial to expand range of fluids which may be brought into contact with the snap-through thermal actuator.

Figure 13:
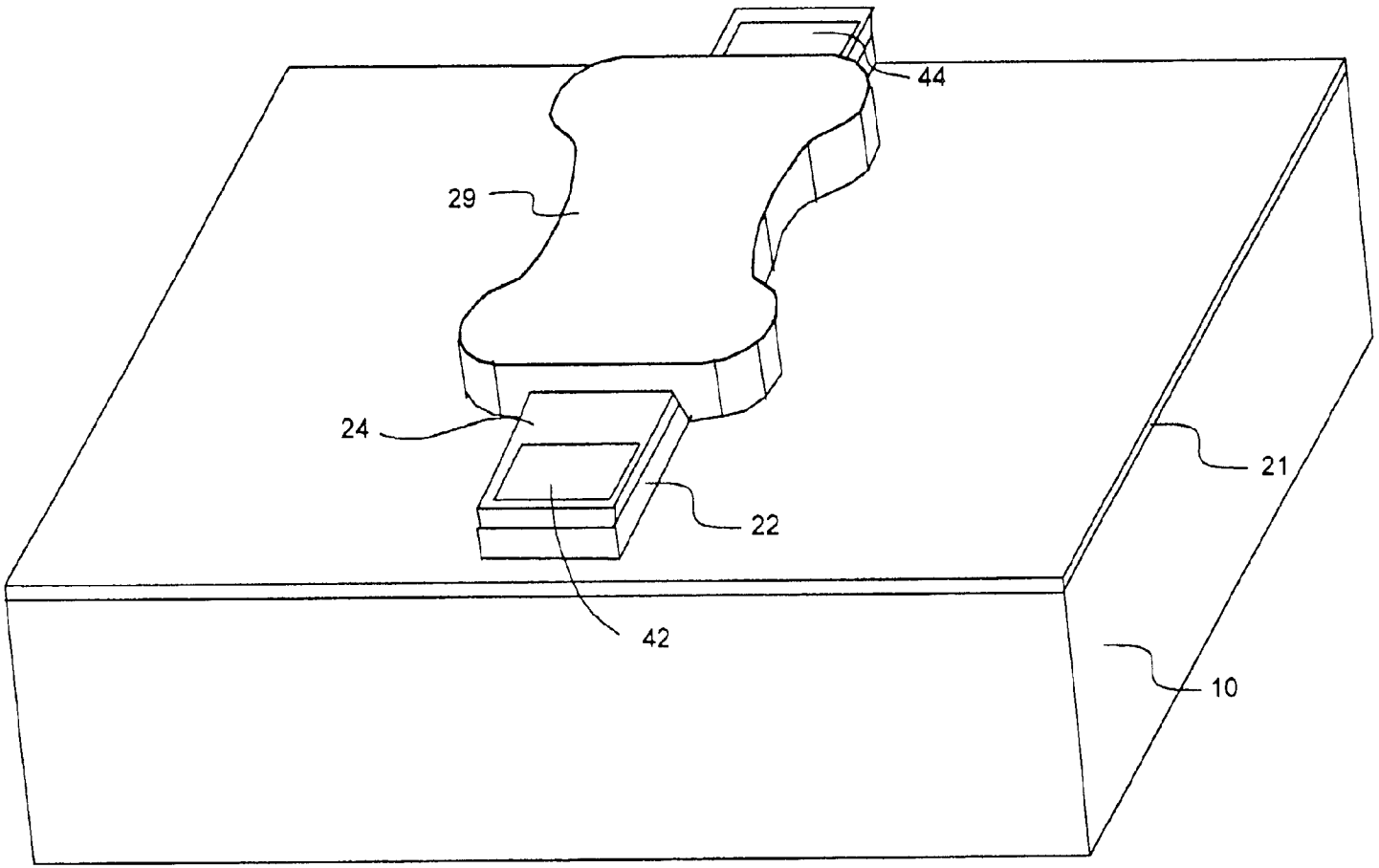
FIG. 13 is a perspective view of the next stages of the process illustrated in FIGS. 10–12 wherein a sacrificial layer in the shape of the liquid filling a chamber of a drop emitter according to the present invention is formed.

FIG. 13 shows the addition of a sacrificial layer 29 which is formed into the shape of the interior of a chamber of a liquid drop emitter. Sacrificial layer 29 is formed over the layers previously deposited. A suitable material for this purpose is polyimide. Polyimide is applied to the device substrate in sufficient depth to also planarize the surface which has the topography of first layer 22, second layer 24 and any additional layers that have been added for various purposes. Any material which can be selectively removed with respect to the adjacent materials may be used to construct sacrificial structure 29.

Figure 14:
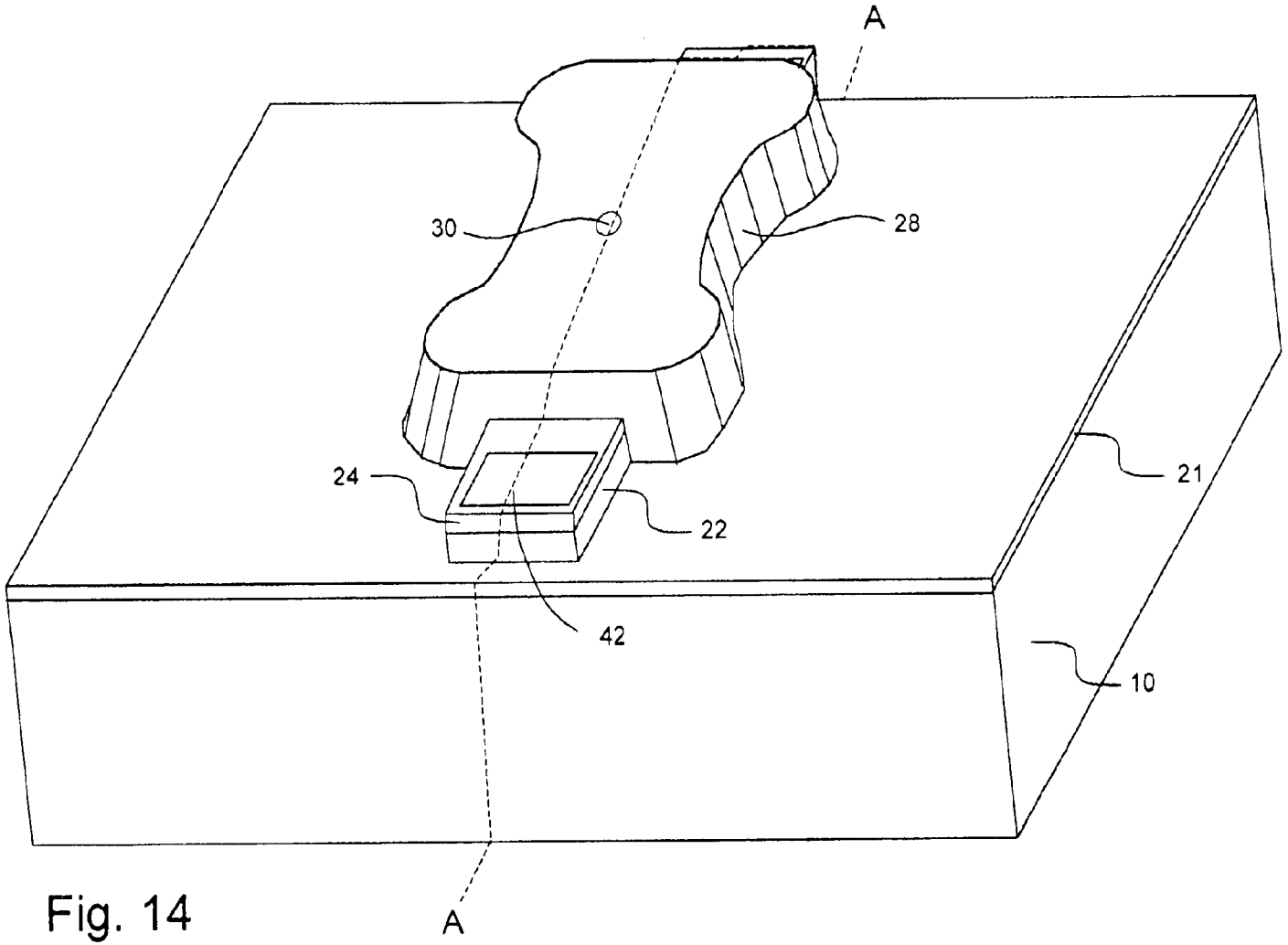
FIG. 14 is a perspective view of the next stages of the process illustrated in FIGS. 10–13 wherein a liquid chamber and nozzle of a drop emitter according to the present invention is formed.

FIG. 14 illustrates drop emitter liquid upper chamber walls and cover 28 formed by depositing a conformal material, such as plasma deposited silicon oxide, nitride, or the like, over the sacrificial layer structure 29. This layer is patterned to complete the drop emitter chamber which will be additionally formed by etching portions of substrate 10 and indicated as chamber 12 in FIGS. 7–9. Nozzle 30 is formed in the drop emitter upper chamber 28, communicating to the sacrificial material layer 29, which remains within the drop emitter upper chamber walls 28 at this stage of the fabrication sequence.

Figure 15A:
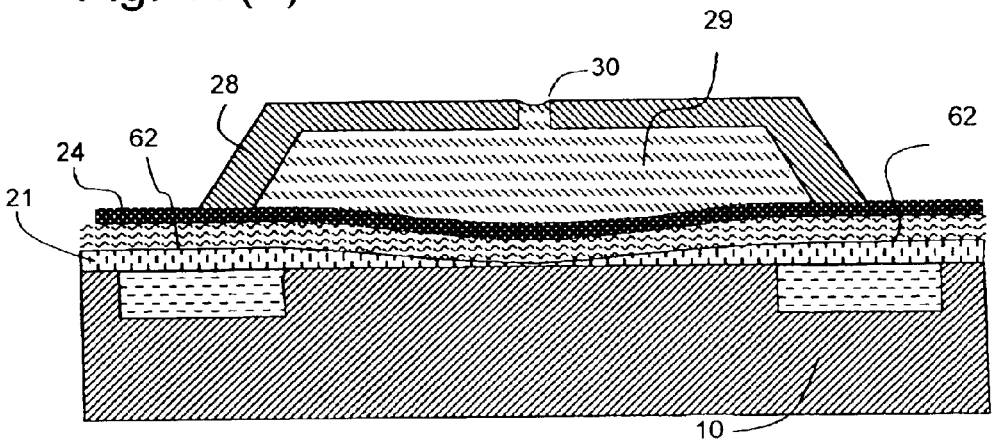
FIG. 15 is a side view of the final stages of the process illustrated in FIGS. 10–14 wherein a liquid supply pathway is formed and the sacrificial layer is removed to complete a liquid drop emitter according to the present invention.
Figure 15B:
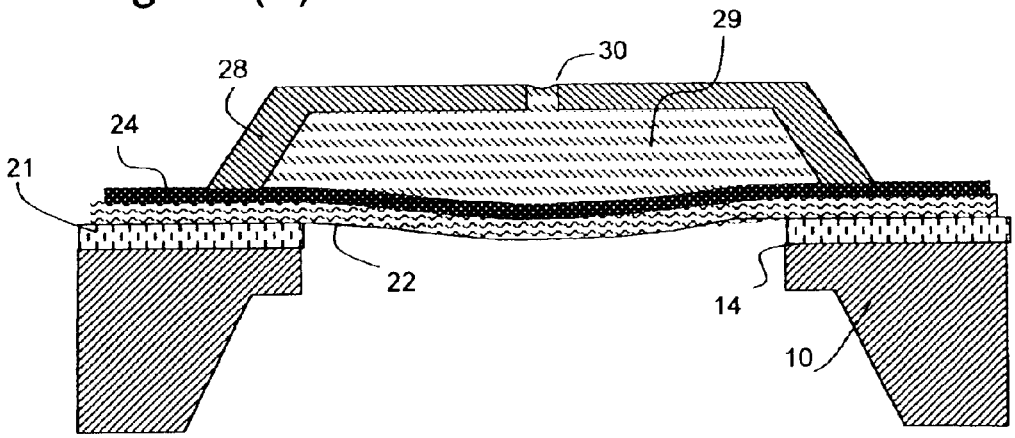

FIG. 15 shows a side view of the device through a section indicated as A—A in FIG. 14. In FIG. 15*a* the sacrificial layer 29 is enclosed within the drop emitter upper chamber walls 28 except for nozzle opening 30. Also illustrated in FIG. 15*a*, substrate 10 is intact. In FIG. 15*b*, substrate 10 and mold layer 21 are removed beneath the deformable element 20 and the liquid chamber areas 12 (see FIGS. 7–9) around and beside the deformable element 20. The removal may be done by an anisotropic etching process such as reactive ion etching, orientation dependent etching for the case where the substrate used is single crystal silicon, or some combination of wet and dry etching methods. For constructing a snap-through thermal actuator alone, the sacrificial structure and liquid chamber steps are not needed and this step of etching away substrate 10 and mold layer 21 may be used to release the deformable element.

Figure 15C:
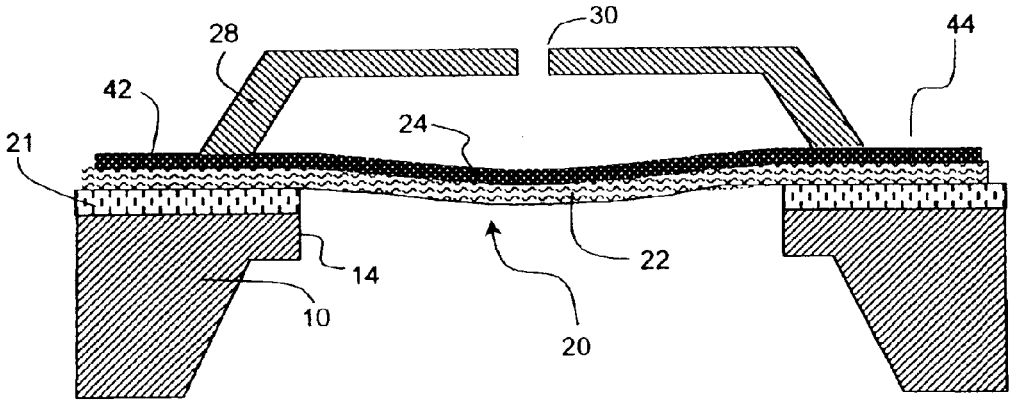

In FIG. 15*c* the sacrificial material layer 29 has been removed by dry etching using oxygen and fluorine sources in the case of the use of a polyimide. The etchant gasses enter via the nozzle 30 and from the newly opened fluid supply chamber area 12, etched previously from the backside of substrate 10. This step releases the deformable element 20 and completes the fabrication of a liquid drop emitter structure.

FIGS. 10 through 15 illustrate a preferred fabrication sequence. However, many other construction approaches may be followed using well known microelectronic fabrication processes and materials. For the purposes of the present invention, any fabrication approach which results in a deformable element including a first layer 22, a second layer 24, a residual shape having a bowing in a direction away from second layer 24, and semi-rigid connection of the deformable element 20 at opposing anchor edges 14, may be followed. Further, in the illustrated sequence of FIGS. 10 through 15, the chamber walls 12, 28 and nozzle 30 of a liquid drop emitter were formed in situ on substrate 10. Alternatively a snap-through thermal actuator could be constructed separately and bonded to a liquid chamber component to form a liquid drop emitter.

Figure 16:
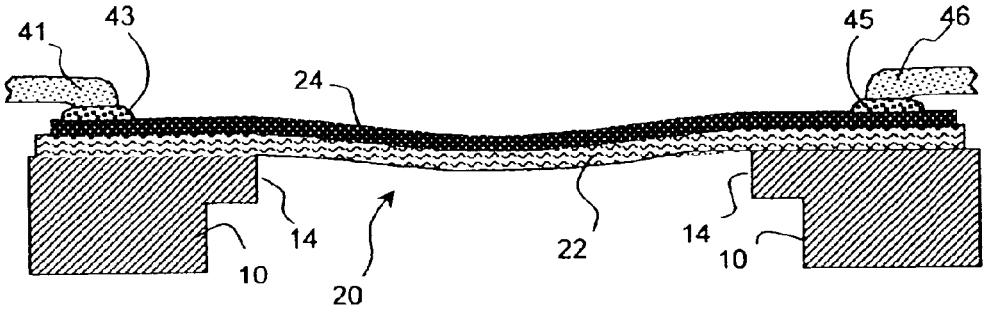
FIG. 16 is a side view illustrating alternative apparatuses adapted to apply heat pulses to the deformable element according the present invention.
Figure 16:
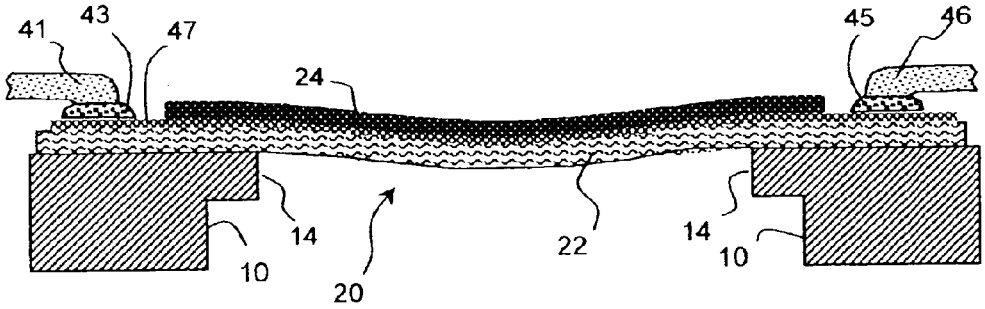

FIGS. 10 through 15 illustrate preferred embodiments in which the second layer is formed of an electrically resistive material. A portion of second layer 24 is formed into a coincident resistor portion carrying current when an electrical pulse is applied to a pair of heater electrodes 42, 44, thereby heating directly the second layer 24. In other preferred embodiments of the present inventions, the second layer 24 is heated by other apparatus adapted to apply heat to the deformable element. For example, a thin film resistor structure can be formed over first layer 22 and then second layer 24 formed upon it. Or, a thin film resistor structure can be formed on top of second layer 24. These three approaches to applying heat to the second layer 24 by electrically resistive means are illustrated in FIG. 16.

Figure 16C:
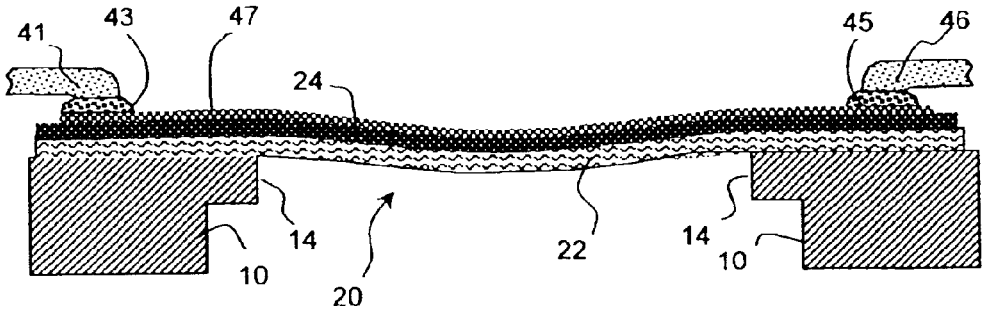

In FIG. 16*a* second layer 24 is coincidentally an electrically resistive heater. Electrical pulses are applied via TAB leads 41,46 and solder bumps 43,45 to heater electrodes 42, 44 of the electrically resistive second layer 24. In FIG. 16*b* a thin film heater resistor structure 47 is positioned at the lower surface of the second layer 24. Electrical connection is made to thin film heater 47 via TAB leads 41,46 and solder bumps 43,45. In FIG. 16*c* a thin film heater resistor structure 47 is positioned at the upper surface of second layer 24. Electrical connection is made to thin film heater 47 via TAB leads 41,46 and solder bumps 43, 45.

It is beneficial to apply heat energy directly to the second layer 24 via good thermal contact means in order to maximize the temperature differential created with respect to first layer 22. There may need to be an electrically insulating layer between an electrically resistive material used to generate heat energy and the second material, especially if the second material is metallic or semi-conducting. Good thermal contact is desirable between an apparatus adapted to supply heat and the deformable element 20 so that rapid heating can be accomplished.

For efficient operation of snap-through thermal actuators according to the present invention, the heat applied to deformable element 20 is preferably introduced in a time of a few microseconds to maximize the thermal spatial gradients. The terms "directly to" and "good thermal contact", as applied to an apparatus adapted to supply heat to the second layer 24, are to be understood in the context of this preferred timing. Such apparatus are adapted to have sufficiently intimate thermal contact and power capabilities so as to supply the required heat energy within a time period that is on the order a few microseconds or less. Heat may be applied more slowly, however, desirable actuator performance characteristics such as maximum deflection, deflection force, and deflection repetition rate may be diminished.

Figure 22A:
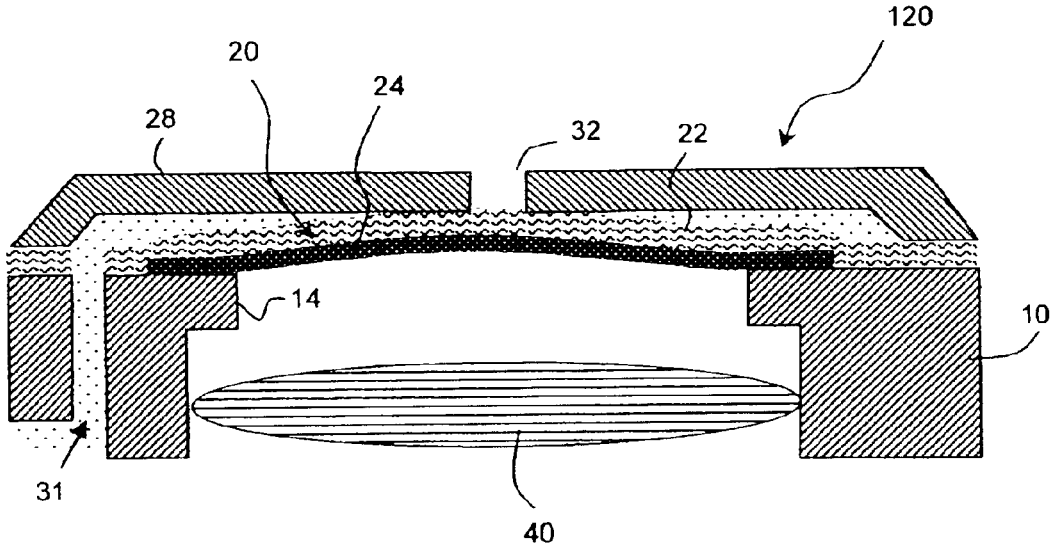
FIG. 22 is a side view illustrating the operation of a normally closed microvalve operated by light energy heating pulses according to preferred embodiments of the present invention.
Figure 22B:
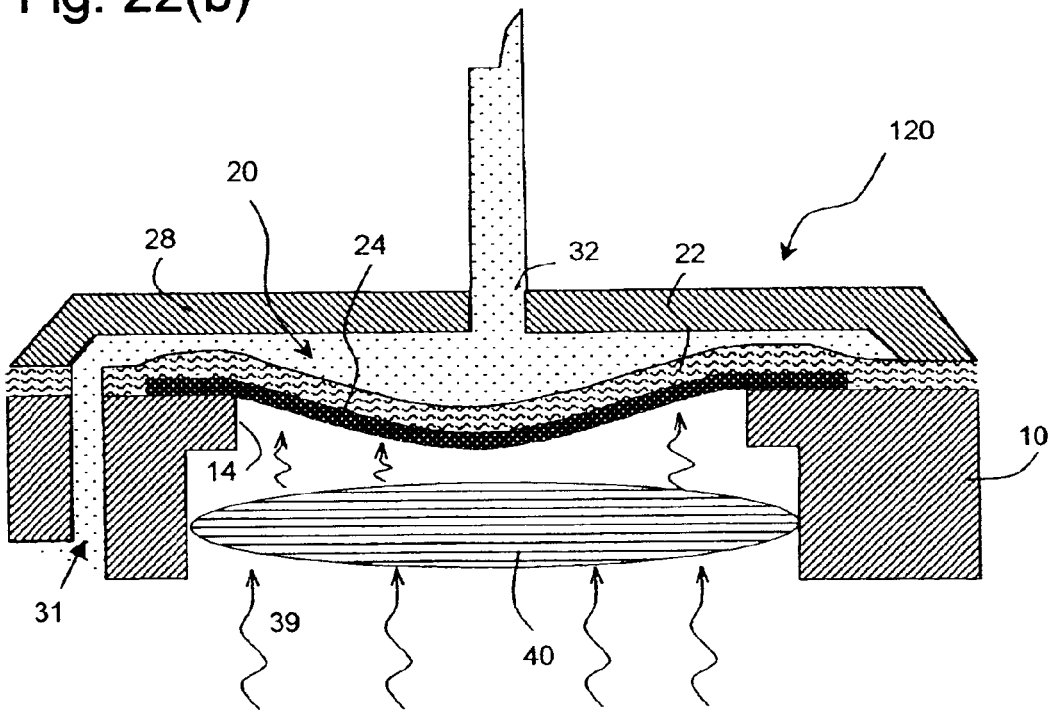

Heat may be introduced to the second layer 24 by apparatus other than by electrical resistors. Pulses of light energy could be absorbed by the first and second layers of the deformable element or by an additional layer added specifically to function as an efficient absorber of a particular spectrum of light energy. The use of light energy pulses to apply heating pulses is illustrated in FIG. 22 hereinbelow in connection with snap-through thermal actuator microvalves according to the present inventions. Any apparatus which can be adapted to transfer pulses of heat energy to the deformable element are anticipated as viable means for practicing the present invention.

Figure 17:
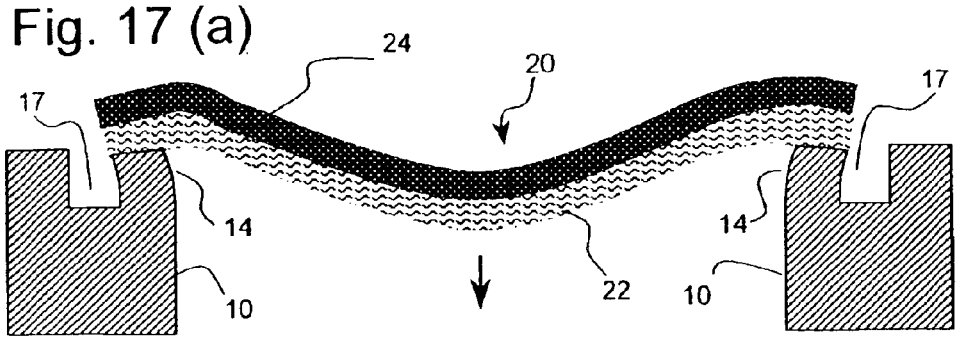
FIG. 17 is a side view illustrating alternative approaches to creating a semi-rigid connection according the present invention.
Figure 17:
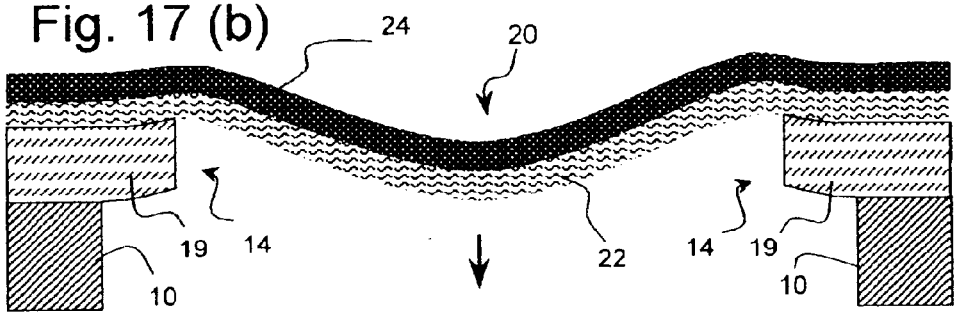
Figure 17:
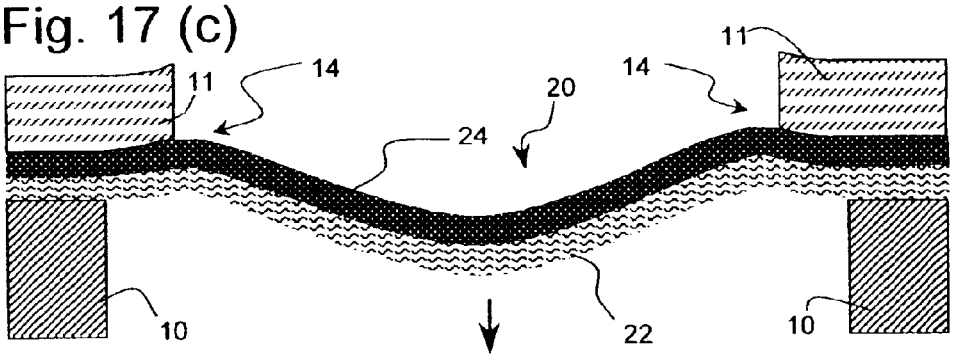
Figure 17:
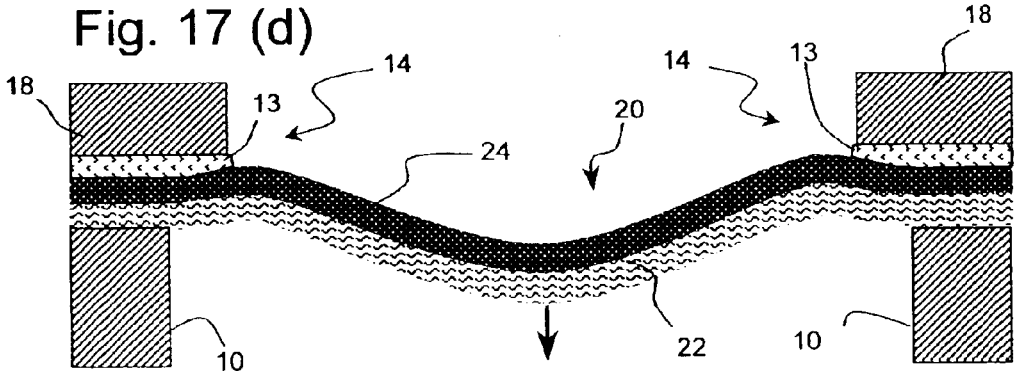

An important requirement for successful snap-through behavior activated by an internal thermal moment is the semi-rigid connection of deformable element 20 to opposing anchor edges 14. FIG. 17 illustrates several approaches to constructing semi-rigid connections in the context of microelectronic fabrication methods. The additional approach of removing a portion of the base element material beneath the opposing anchor edges was previously discussed and illustrated, for example in FIG. 2.

FIG. 17*a* illustrates an alternate location for removing a relief portion 17 of the base element material near opposing anchor edges 14. Relief portions 17 of material are removed just behind opposing anchor edges 14 rendering the opposing anchor edges somewhat flexible, thereby contributing flexibility to the attachment of the deformable element 20 and enabling the formation of a semi-rigid connection according to the present inventions. The stiffness of the semi-rigid connection may be explored experimentally by creating a series of devices having relief portions of substrate material removed to varying depths at different spacings behind the opposing anchor edges. Snap-through transition behavior may then be observed versus different relief portion 17 parameters to identify an optimal design for a specific device application.

FIG. 17*b* illustrates the addition of an anchor edge layer 19 of material beneath deformable element 20. An anchor edge configuration similar to that formed by etching away a relief portion of the substrate material is formed. The use of an anchor edge material may be an advantageous alternative by allowing the incorporation of more flexible materials or better control of the final dimensions of the opposing anchor edge region during fabrication. The role of anchor edge layer 19 in the design is to provide some flexibility to the attachment of the deformable element to the opposing anchor edges, creating semi-rigid connections. The stiffness of the semi-rigid connection may be explored experimentally by creating a series of devices using anchor edge materials having different mechanical properties, thickness and extension beneath opposing anchor edges 14. Snap-through transition behavior may then be observed versus these parameter variations to identify an optimal design for a specific device application.

FIG. 17*c* illustrates the addition of a perimeter stiffness layer 11 of material added to the perimeter edge of the deformable element. This effectively re-locates the opposing anchor edges 14 to a position above the deformable element as illustrated. An anchor edge configuration similar to that formed by the introduction of anchor edge layer 19 discussed above is formed. The use of a perimeter stiffness layer in the position illustrated above second layer 24 may be an advantageous alternative by allowing the incorporation of flexible materials at a later stage of the fabrication process, for example after necessary high temperature depositions during fabrication. The role of perimeter stiffness layer 11 in the design is to provide some flexibility to the attachment of the deformable element to the opposing anchor edges 14, creating semi-rigid connections. The stiffness of the semi-rigid connection may be explored experimentally by creating a series of devices using perimeter stiffness layer 11 materials having different mechanical properties, thickness and extension outward of the base element 10 beneath the deformable element 20. Snap-through transition behavior may then be observed versus these parameter variations to identify an optimal design for a specific device application.

FIG. 17*d* illustrates a variation of the semi-rigid connection design illustrated in FIG. 17*c*. In this case a thin, flexible joint material 13 is used together with a rigid clamping layer 18 and positioned above second layer 24 of the deformable element 20. In this case flexible joint material 13 provides the joint flexibility needed to form a semi-rigid connection. The stiffness of the semi-rigid connection may be explored experimentally by creating a series of devices using different thickness and compositions for flexible joint material 13 and extensions of rigid clamping layer 18. Snap-through transition behavior may then be observed versus these parameter variations to identify an optimal design for a specific device application.

Snap-through thermal actuators according to the present inventions are useful in the construction of fluid microvalves. A normally closed fluid microvalve configuration is illustrated in FIG. 18 and a normally open fluid microvalve is shown in FIG. 19. For both normally open and normally closed valve configurations, the snap-through thermal actuator is advantageous because of the rapid physical movement of the deformable element 20 during a snap-through transition. Rapid switching from open to closed states, or vice versa, is needed for digital micro-metering of fluids or systems that need to minimize the time duration of intermediate fluid pressure states. For example continuous inkjet systems require the rapid start-up and shut-down of the pressurized ink supply source in order to minimize the amount of ink that is emitted at low velocities, fouling electrostatic charging and deflection components.

Figure 18A:
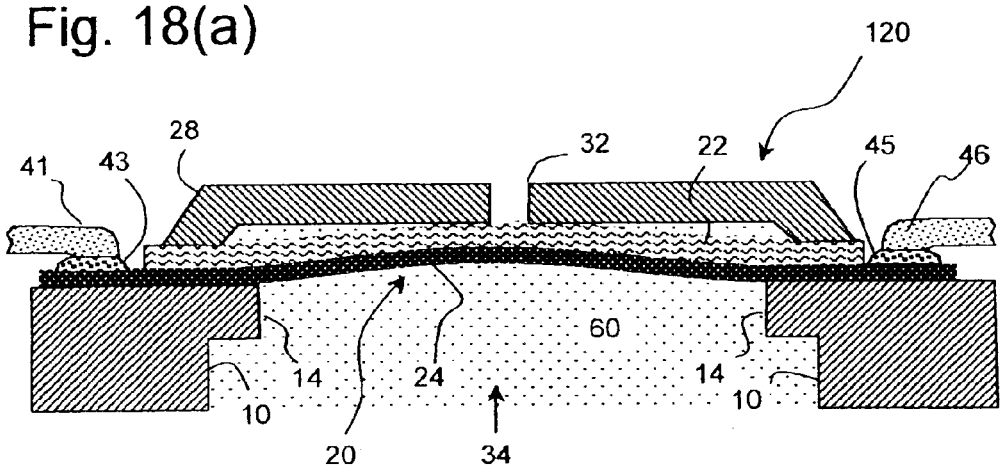
FIG. 18 is a side view illustrating the operation of a normally closed microvalve according to preferred embodiments of the present invention.
Figure 18B:
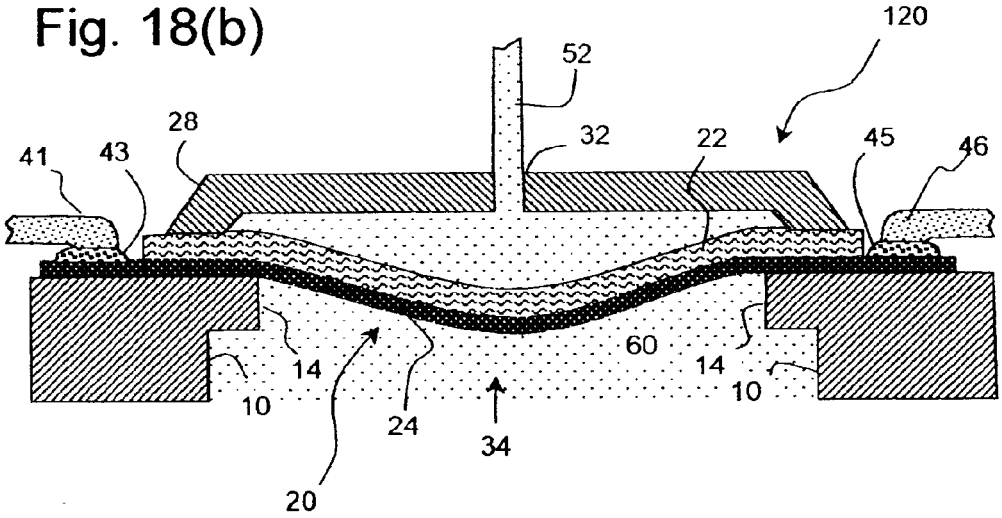

A normally closed microvalve may be configured as shown in FIG. 18*a* so that first layer 22 is urged against a fluid flow port 32 when the deformable element 20 is in its residual shape bowed in a direction away from second layer 24. In the configuration illustrated, fluid is admitted from a source under pressure via an inlet path 34. When a heat pulse is applied to deformable element 20, the initial deformation causes the deformable element to push more forcefully against fluid flow port 32. This is beneficial to a normally closed valve in that it assures that there is not an undesirable initial flutter of the pressure. Then, when the snap-through transition of the deformable element occurs, the valve opens to a maximum extent (FIG. 18*b*) as rapidly as the snap-through buckling occurs, emitting stream 52. The valve may be maintained in an open state by continuing to heat the deformable element sufficiently to maintain the upward buckled state.

Figure 19A:
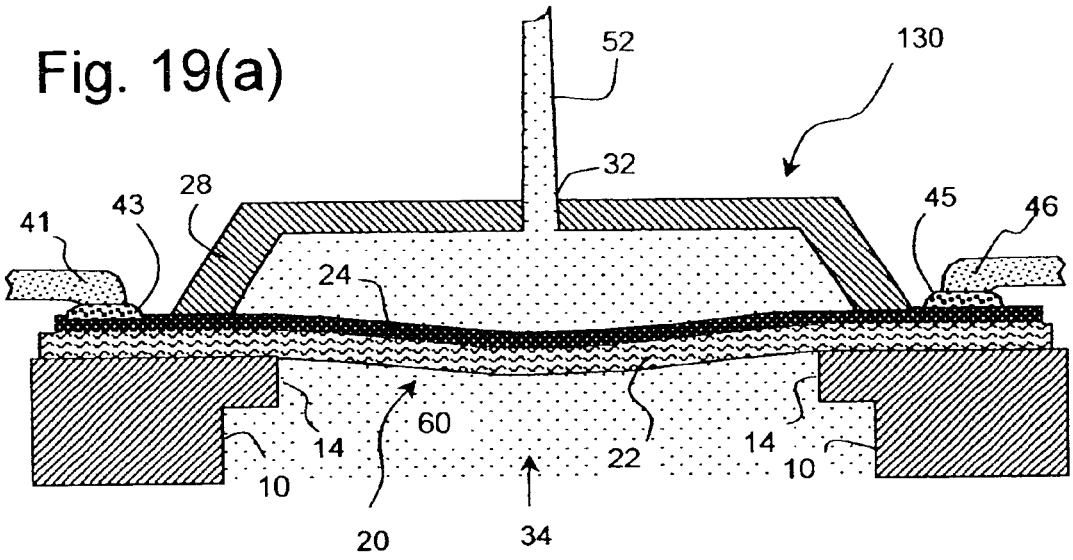
FIG. 19 is a side view illustrating the operation of a normally open microvalve according to preferred embodiments of the present invention.
Figure 19B:
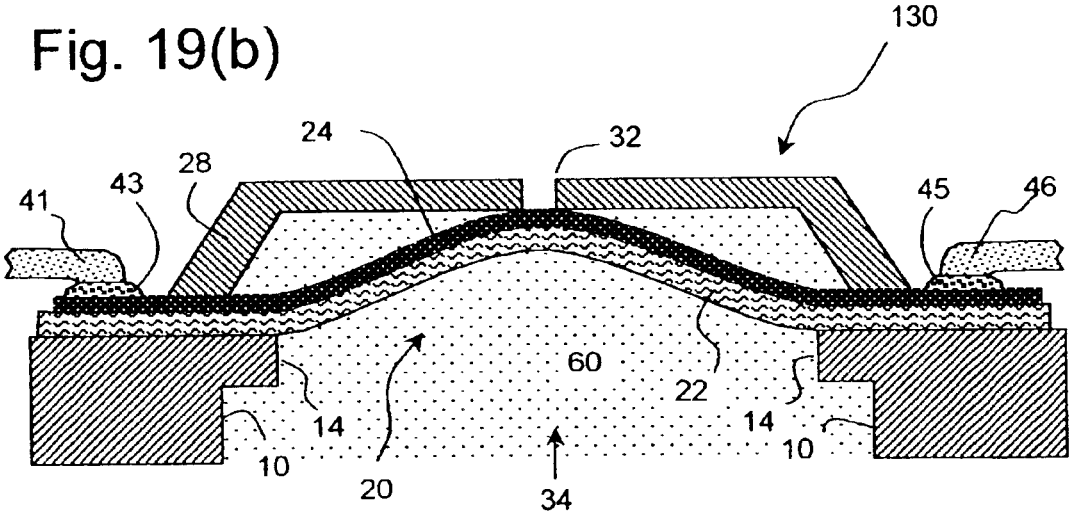

A normally open microvalve may be configured as shown in FIG. 19*a*. The deformable element 20 is positioned in proximity to a fluid flow port 32, sufficiently close so that after the snap-through buckling transition the deformation is sufficient to close flow port 32. The deformable element is further positioned so that the residual shape is bowed away from the fluid flow port in the normal state of the valve. This configuration allows fluid to flow freely from a pressure source via an inlet path 34 out the fluid flow port 32 forming stream 52. When a heat pulse is applied to deformable element 20, the initial deformation causes the deformable element to buckle farther away from fluid flow port 32, not disturbing the normal flow. Then, when the snap-through transition occurs, the valve closes by urging the deformable element against fluid flow port 32. The valve may be maintained in a closed state by continuing to heat the deformable element sufficiently to maintain the upward buckled state.

Figure 20A:
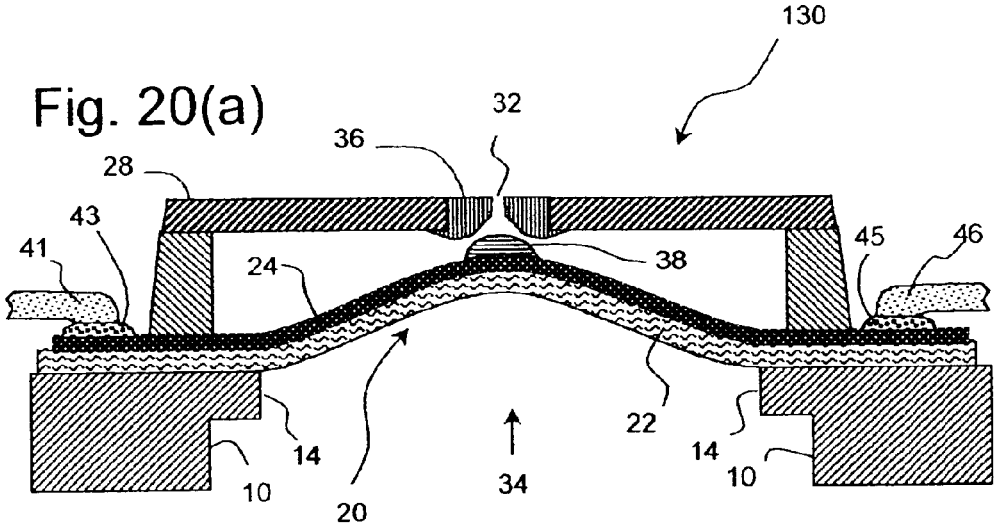
FIG. 20 is a side view illustrating a valve sealing member and a valve seat of a normally open and a normally closed microvalve according to preferred embodiments of the present invention.
Figure 20B:
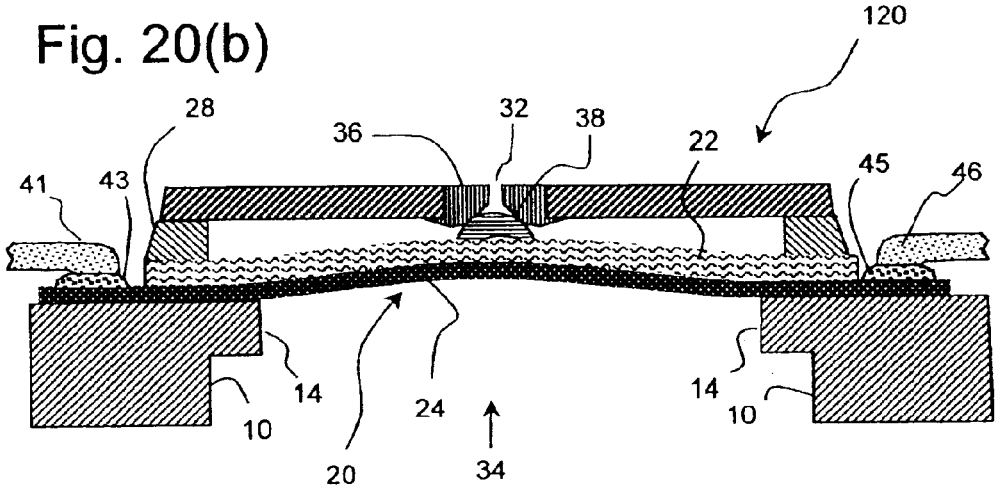

FIG. 20 illustrates microvalves according to the present inventions which further comprise a valve sealing member 38 which is urged against fluid flow port 32 by deformable element 20. In addition, a valve seat 36 positioned around the opening of fluid flow port 32 which receives valve sealing member 38 may also be used to improve the reliability of the microvalve opening and closing action according to the present inventions. A normally open microvalve configuration is illustrated in FIG. 20*a* at a time just prior to valve closing by deformable element 20. A normally closed microvalve configuration is illustrated in FIG. 20*b* in its normally closed state before the application of a heat pulse to deformable element 20.

The previously discussed illustrations of snap-through thermal actuators, liquid drop emitters and microvalves have shown deformable elements in the shape of thin rectangular microbeams attached at opposite ends to opposing anchor edges in a semi-rigid connection. The long edges of the deformable elements were not attached and were free to move resulting in a two-dimensional buckling deformation. Alternatively, a deformable element may be configured as a plate which is attached, using a semi-rigid connection, around a fully closed perimeter. FIG. 21 illustrates in plan view a deformable element 20 configured as a circular laminate attached fully around its circular perimeter. Such a deformable element will buckle, or pucker, in a three-dimensional fashion. A fully attached perimeter configuration of the deformable element may be advantageous when is undesirable to operate the deformable element in contact with a working fluid. Or, it may also be beneficial that the deformable element work against air, a vacuum, or other low resistance medium on one of its faces while deforming against the working fluid of the application impinging the opposite face.

Figure 21A:
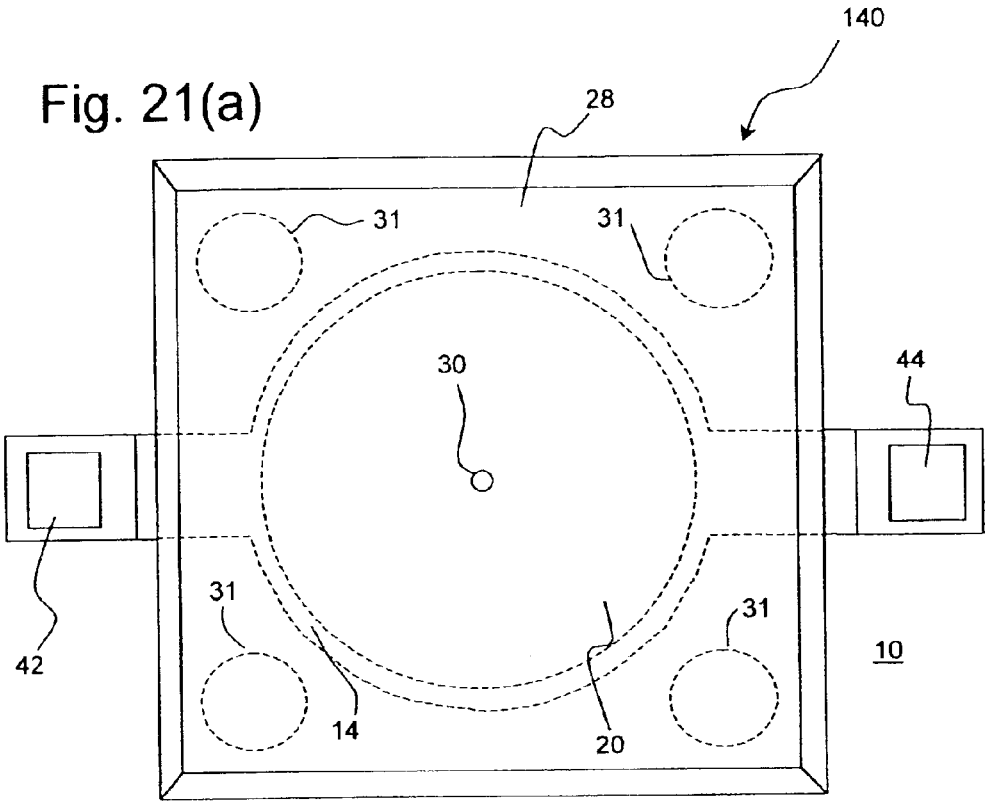
FIG. 21 is a plan view illustrating a deformable member which is anchored around a fully closed perimeter according to preferred embodiments of the present invention.
Figure 21B:
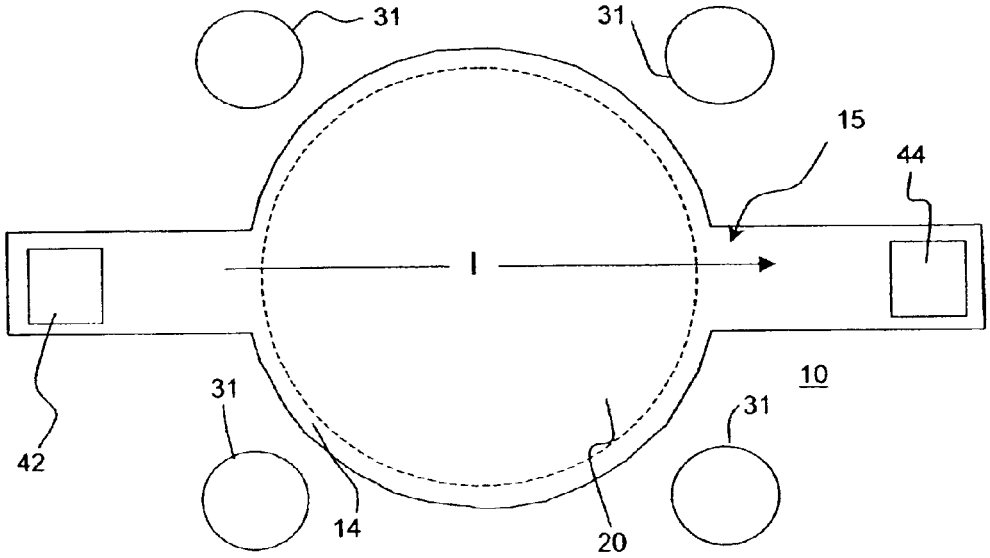

FIG. 21*a* illustrates a liquid drop emitter having a square fluid upper chamber 28 with a central nozzle 30. Shown in phantom in FIG. 21*a*, a circular deformable element 20 is semi-rigidly connected to peripheral anchor edge 14. Deformable element 20 forms a portion of a bottom wall of a fluid chamber. Fluid enters the chamber via inlet ports 31. In FIG. 21*b* the upper chamber 28 is removed. The heat pulses are applied by passing current via heater electrodes 42 and 44 through a electrically resistive layer included in the laminate structure of deformable element 20.

FIG. 22 illustrates an alternative embodiment of the present inventions in which the deformable element is a circular laminate attached semi-rigidly around the full circular perimeter. The deformable element forms a portion of a wall of a normally closed microvalve. The second layer 24 side of the deformable element has been configured to be accessible to light energy 39 directed by light collecting and focusing element 40. Fluid may enter the microvalve via inlet port 31. The valve is operated by directing a pulse of light energy of sufficient intensity to heat the deformable element through the appropriate temperature time profile to cause snap-through buckling. The valve may be maintained in an open state by continuing to supply light energy pulses sufficient to maintain a sufficiently elevated temperature of the deformable element.

A light-activated device according to the present inventions may be advantageous in that complete electrical and mechanical isolation may be maintained while opening the microvalve. A light-activated configuration for a liquid drop emitter, microvalve, or other snap-through thermal actuator may be designed in similar fashion according to the present inventions.

Figure 23:
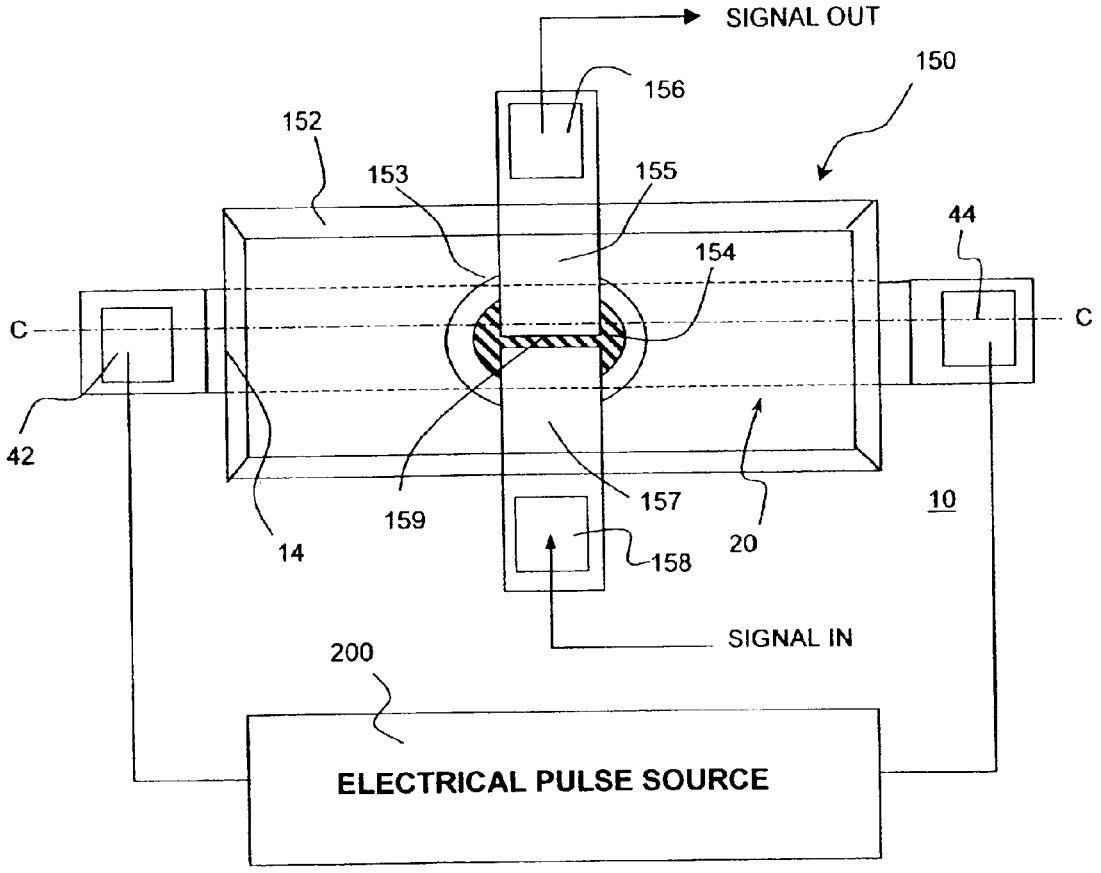
FIG. 23 is a plan view illustrating an electrical microswitch according to preferred embodiments of the present invention.
Figure 24A:
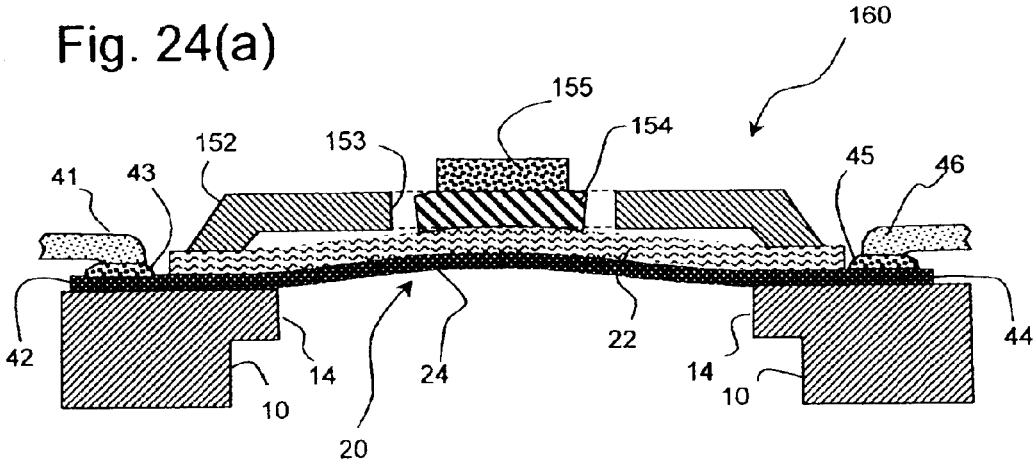
FIG. 24 is a side view illustrating the operation of a normally closed microswitch according to preferred embodiments of the present invention.

Snap-through thermal actuators according to the present inventions are also useful in the construction of microswitches for controlling electrical circuits. A plan view of a microswitch unit 150 according to the present inventions is illustrated in FIG. 23. FIG. 24 illustrates in side view a normally closed microswitch unit 160 configuration and FIG. 25 illustrates in side view a normally open microswitch unit 170. For both normally open and normally closed microswitch configurations, the snap-through thermal actuator is advantageous because of the rapid physical movement of the deformable element 20 during a snap-through transition. Rapid switching from open to closed states, or vice versa, is needed for systems that need to minimize the time duration of intermediate, hence, indefinite, electrical states.

In the plan view illustration of FIG. 23, the deformable element 20 is heated by electroresistive means. Electrical pulses are applied by electrical pulse source 200 via heater electrodes 42 and 44. The microswitch controls an electrical circuit via first switch electrode 155 and second switch electrode 157. First switch electrode 155 and second switch electrode 157 are supported by a spacer support 152 in a position above the deformable element 20. A space 159 separates first and second switch electrodes 155,157 so that an external circuit connected to switch input pads 156 and 158 is open unless the first and second switch electrodes are electrically bridged. A control electrode 154, beneath the first and second switch electrodes 155, 157 may be urged into bridging contact via electrode access opening 153 in spacing structure 152. Control electrode 154 is constructed of a highly conductive material. Deformable element 20 is positioned to move the control electrode towards or away from the first and second switch electrodes 155,157 as it is made to undergo snap-through buckling by the application of heat pulses.

Figure 24B:
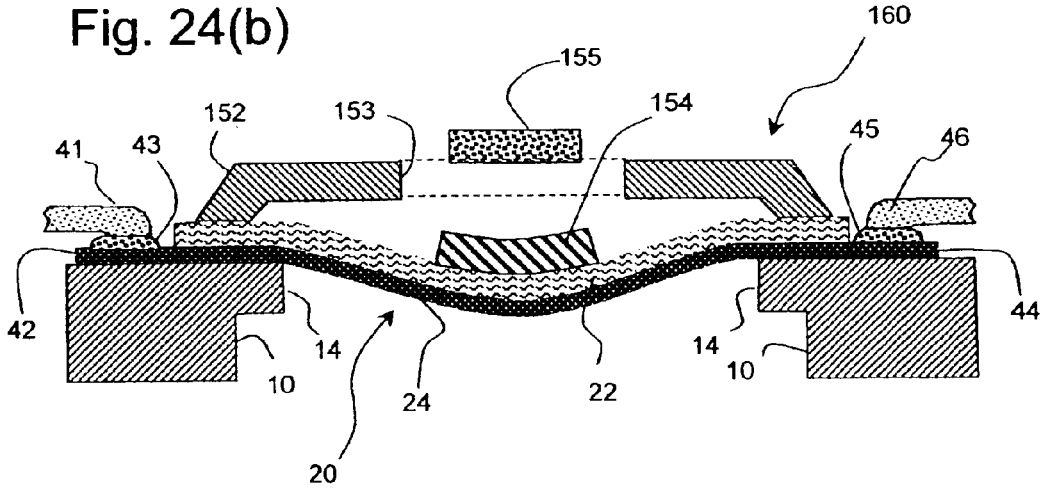
Figure 25A:
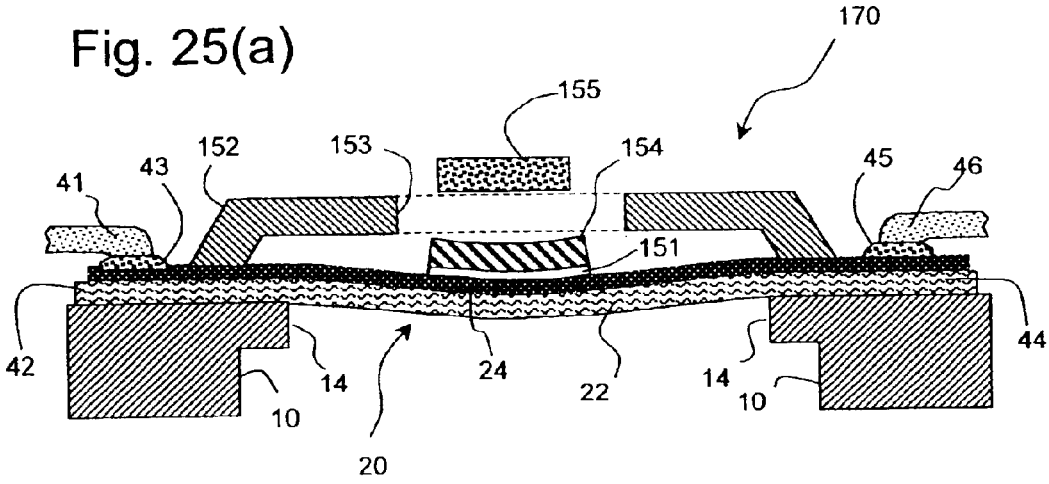
FIG. 25 is a side view illustrating the operation of a normally open microswitch according to preferred embodiments of the present invention.
Figure 25B:
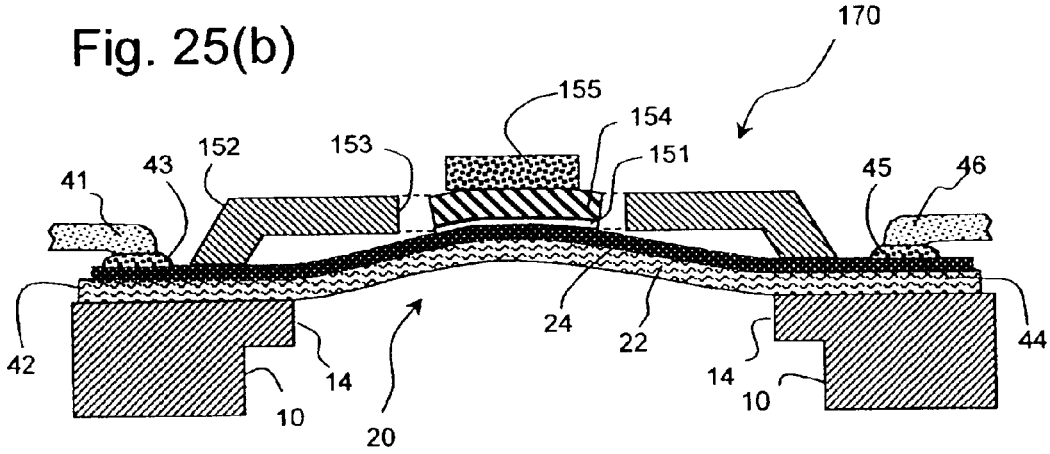

A normally closed microswitch may be configured as illustrated in FIG. 24. The side views of FIG. 24 are formed along line C—C in FIG. 23. First layer 22 of the deformable element 20 urges control electrode 154 into contact with first switch electrode 155 and second switch electrode 157 (not shown) when the deformable element 20 is in its residual shape bowed in a direction away from second layer 24, thereby closing the external circuit via input pads 156,158 (not shown). When a heat pulse is applied to deformable element 20, the initial deformation causes the deformable element to push more forcefully against control electrode 154. This is beneficial to a normally closed microswitch in that it assures that there is not an undesirable initial flutter of the electrical connection. Then, when the snap-through transition of the deformable element occurs, the microswitch opens to a maximum extent (FIG. 24*b*) as rapidly as the snap-through buckling occurs, breaking the external circuit, i.e., opening the microswitch. The microswitch may be maintained in an open state by continuing to heat the deformable element sufficiently to maintain the upward buckled state.

A normally open microswitch may be configured as shown in FIG. 25. The side views of FIG. 24 are formed along line C—C in FIG. 23. The deformable element 20 is positioned in close proximity to electrode access opening 159, sufficiently close so that after the snap-through buckling transition the deformation is sufficient to urge control electrode 154 into bridging contact with first switch electrode 155 and second switch electrode 157 (not shown). The deformable element is further positioned so that the residual shape is bowed away from electrode access opening 153 in the normal state of the microswitch, holding the external circuit open. When a heat pulse is applied to deformable element 20, the initial deformation causes the deformable element to buckle farther away from electrode access opening 153. Then, when the snap-through transition occurs, the microswitch closes by urging control electrode 154 into electrical contact with first and second switch electrodes 155, 157. The valve may be maintained in a closed state by continuing to heat the deformable element sufficiently to maintain the upward buckled state. For embodiments of the present invention wherein second layer 24 is electrically resistive, an electrical insulation layer 151 may be provided under control electrode 154.

For the microswitch configurations illustrated in FIGS. 23–25, both the first and second switch electrodes are supported by the spacing structure 152 and the control electrode 154 make bridging contact with both to open or close the switch. An alternate microswitch configuration is illustrated in FIG. 26 wherein the second switch electrode 157 is formed onto the deformable element and into permanent electrical contact with the control electrode 154. First switch electrode 155 is supported by spacing structure 152 and is accessible for contact by the control electrode via electrical access opening 153. In this illustrated embodiment of the present inventions, microswitch opening and closing therefore results from the deformable element 20 urging control electrode 154 into and out of contact with first switch electrode 155.

Figure 26A:
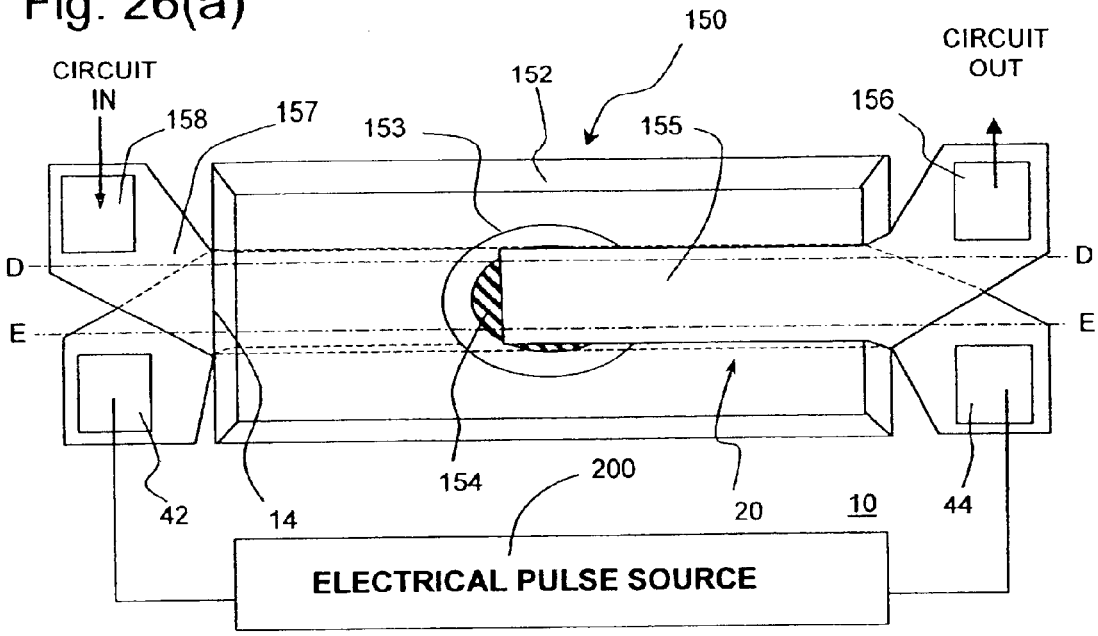
FIG. 26 is a plan view and a side view illustrating an alternate design for a electrical microswitch according to preferred embodiments of the present invention.
Figure 26B:
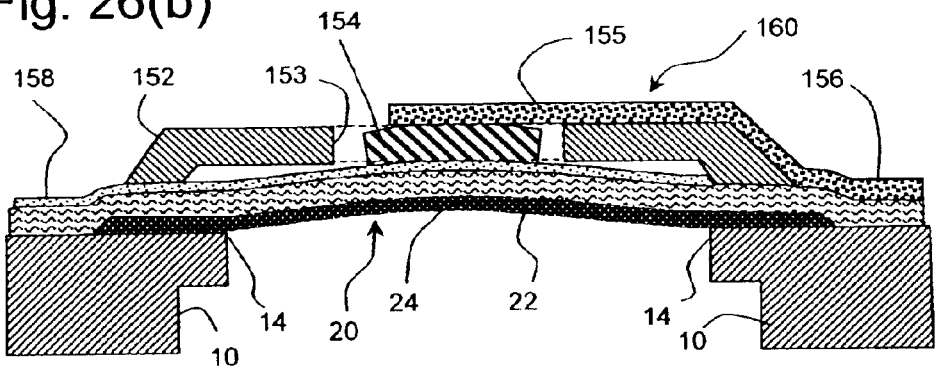
Figure 26C:
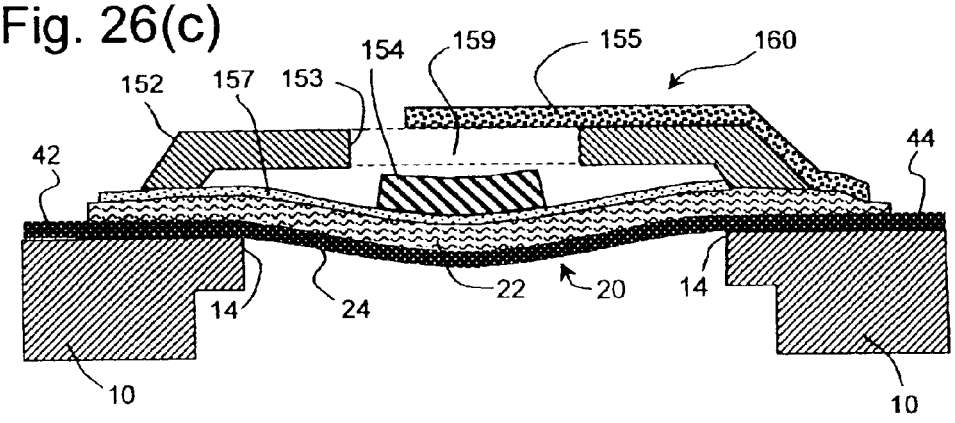

FIG. 26*a* illustrates in plan view the alternative microswitch unit 150 configuration having second switch electrode and control electrode 154 in permanent electrical contact. FIG. 26*a* illustrates a side view of a normally closed microswitch unit 160 according to this configuration of the present inventions. The FIG. 26*b* side view is formed along line D—D of FIG. 26*a* and shows the switch in a residual, normally closed state. In this view, external electrical circuit input leads 156 and 158 are seen but heater electrodes 42,44 attached to electroresistive means for heating the deformable element are not shown. FIG. 26*c* illustrates a side view of a normally closed microswitch unit 160 after a heat pulse has been applied and the deformable element has undergone snap-through buckling, opening a space 159 between control electrode 154 and first switch electrode 155, thereby opening external circuit. FIG. 26*c* is formed along line E—E in FIG. 26*a*, and shows heater electrodes 42,44 but not input leads 156,158.

The previously discussed illustrations of snap-through thermal actuator microvalves have shown deformable elements in the shape of thin rectangular microbeams attached at opposite ends to opposing anchor edges. The long edges of the deformable elements were not attached and were free to move resulting in a two-dimensional buckling deformation. Alternatively, a deformable element for a microswitch may be configured as a plate which is attached, using a semi-rigid connection, around a fully closed perimeter as was illustrated in FIG. 21 above for a microvalve. A fully attached perimeter configuration of the deformable element may be advantageous when is undesirable to operate the deformable element in a vacuum, or other low resistance gas on the face opposite to the control electrode.

Figure 27A:
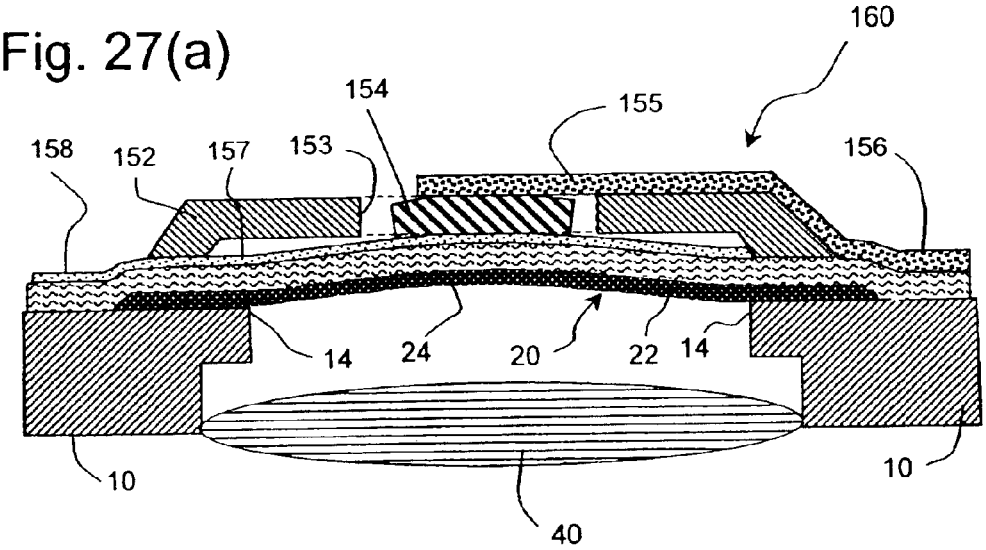
FIG. 27 is a side view illustrating the operation of a normally closed microswitch operated by light energy heating pulses according to preferred embodiments of the present invention.
Figure 27B:
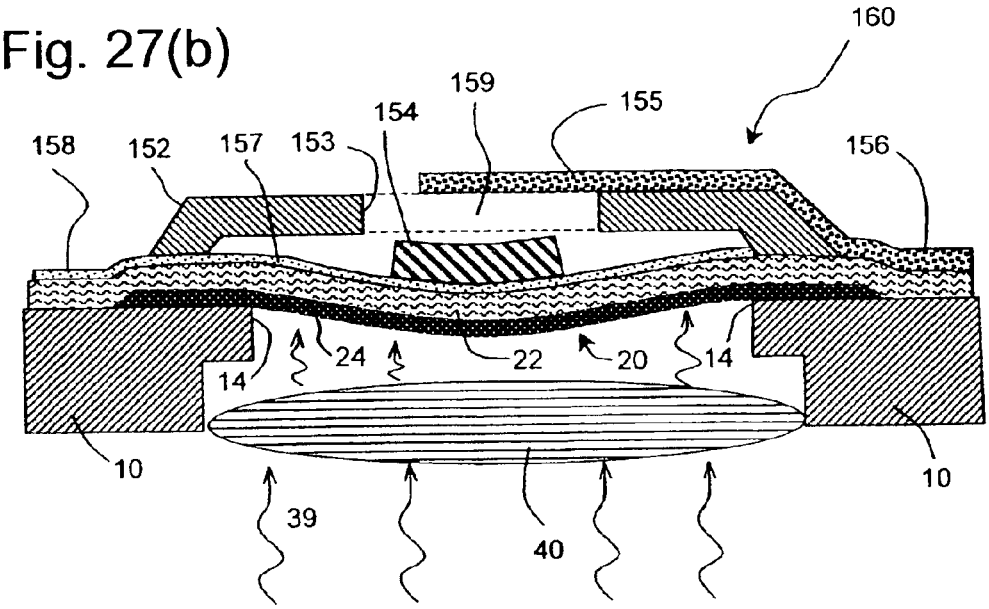

FIG. 27 illustrates in side view an alternative embodiment of a normally closed microswitch unit 160 in which the deformable element is a circular laminate attached around the full circular perimeter. The second layer 24 side of the deformable element has been configured to be accessible to light energy 39 directed by light collecting and focusing element 40. The microswitch is operated by directing a pulse of light energy of sufficient intensity to heat the deformable element through the appropriate temperature time profile to cause snap-through buckling. The microswitch may be maintained in an open state by continuing to supply light energy pulses sufficient to maintain a sufficiently elevated temperature of the deformable element.

A light-activated device according to the present inventions may be advantageous in that complete electrical and mechanical isolation may be maintained while opening the microswitch. A light-activated configuration for a normally open microswitch may be designed in similar fashion according to the present inventions.

While much of the foregoing description was directed to the configuration and operation of a single snap-through thermal actuator, liquid drop emitter, microvalve, or microswitch, it should be understood that the present invention is applicable to forming arrays and assemblies of such single device units. Also it should be understood that snap-through thermal actuator devices according to the present invention may be fabricated concurrently with other electronic components and circuits, or formed on the same substrate before or after the fabrication of electronic components and circuits.

Further, while the foregoing detailed description primarily discussed snap-through thermal actuators heated by electrically resistive apparatus, or pulsed light energy, other means of generating heat pulses, such as inductive heating, may be adapted to apply heat pulses to the deformable elements according to the present invention.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 substrate base element
11 perimeter stiffness layer
12 liquid chamber
12*c* liquid chamber narrowed wall portion
13 flexible joint material
14 opposing anchor edges at deformable element anchor
15 snap-through thermal actuator
17 relief portion of the base element
18 rigid clamping layer
19 anchor edge layer
20 deformable element
20*a* deformable element central portion
20*b* deformable element anchor portion
21 mold layer
22 first layer
24 second layer
28 liquid chamber structure, walls and cover
29 sacrificial layer
30 nozzle
31 fluid inlet port
32 fluid flow port
34 fluid inlet path
36 valve seat
38 valve sealing member
39 light energy
40 light directing element
41 TAB lead
42 heater electrode
43 solder bump
44 heater electrode
45 solder bump
46 TAB lead
47 electroresistive element, thin film heater resistor
50 drop
52 fluid stream
60 fluid
61 mold depression
62 etch stop region
80 mounting structure
100 ink jet printhead
110 drop emitter unit
120 normally closed microvalve unit
130 normally open microvalve unit
150 microswitch unit
151 electrical insulation layer under control electrode
152 spacing structure
153 electrode access opening
154 control electrode
155 first switch electrode
156 input pad to first switch electrode
157 second switch electrode
158 input pad to second switch electrode
159 space between first and second switch electrodes
160 normally closed microswitch unit
170 normally open microswitch unit
200 electrical pulse source
300 controller
400 image data source
500 receiver

What is claimed is:

1. A normally closed microswitch for controlling an electrical circuit comprising;

(a) a base element formed with a depression having opposing anchor edges, said opposing anchor edges defining a central plane;

(b) a spacing structure supported by the base element;

(c) a first switch electrode supported by the spacing structure, a second switch electrode spaced away from the first switch electrode, and a control electrode for electrically connecting the first and second switch electrodes to close the electrical circuit;

(d) a deformable element attached to the opposing anchor edges urging the control electrode into electrical contact with the first and second switch electrodes, the deformable element constructed as a planar lamination including a first layer of a first material having a low coefficient of thermal expansion and a second layer of a second material having a high coefficient of thermal expansion, the deformable element formed to have a residual shape bowing outward from the central plane in a first direction away from the second layer and towards the first switch electrode; and (e) apparatus adapted to apply a heat pulse to the deformable element, causing a sudden rise in the temperature of the deformable element, the deformable element initially bowing farther outward in the first direction, then, due to thermomechanical torque's acting at the opposing anchor edges, reversing and snapping through the central plane to bow outward in a second direction toward the second layer, moving the control electrode out of contact with the first switch electrode thereby opening the electrical circuit, and then relaxing to the residual shape, closing the electrical circuit as the temperature decreases thereof.

2. The normally closed microswitch of claim 1 wherein the second switch electrode is supported by the spacing structure.

3. The normally closed microswitch of claim 1 wherein the second switch electrode is electrically attached to the control electrode.

4. The normally closed microswitch of claim 1 wherein the apparatus adapted to apply a heat pulse to the deformable element comprises an electroresistive element in good thermal contact with the deformable element.

5. The normally closed microswitch of claim 1 wherein the second material is an electrically resistive material and the apparatus adapted to apply a heat pulse to the deformable element comprises a pair of heater electrodes connected to the second layer to allow an electrical current to be passed through a portion of the second layer.

6. The normally closed microswitch of claim 1 wherein the apparatus adapted to apply a heat pulse to the deformable element comprises light directing elements to allow light energy pulses to impinge the deformable element.

7. The normally closed microswitch of claim 1 wherein the deformable element is constructed as a planar lamination of a plurality of layers and the residual shape of the deformable element results from an accumulation of residual stains in the plurality of layers.

8. A normally closed microswitch for controlling an electrical circuit comprising;

(a) a base element formed with a depression having opposing anchor edges, said opposing anchor edges defining a central plane;

(b) a spacing structure supported by the base element;

(c) a first switch electrode supported by the spacing structure, a second switch electrode spaced away from the first switch electrode, and a control electrode for electrically connecting the first and second switch electrodes to close the electrical circuit;

(d) a deformable element attached by a semi-rigid connection to the opposing anchor edges urging the control electrode into electrical contact with the first and second switch electrodes, the deformable element constructed as a planar lamination including a first layer of a first material having a low coefficient of thermal expansion and a second layer of a second material having a high coefficient of thermal expansion, the deformable element formed to have a residual shape bowing outward from the central plane in a first direction away from the second layer and towards the first switch electrode; and (e) apparatus adapted to apply a heat pulse to the deformable element, causing a sudden rise in the temperature of the deformable element, the deformable element initially bowing farther outward in the first direction, then reversing and snapping through the central plane to bow outward in a second direction toward the second layer, moving the control electrode out of contact with the first switch electrode thereby opening the electrical circuit, and then relaxing to the residual shape, closing the electrical circuit as the temperature decreases thereof.

9. The normally closed microswitch of claim 8 wherein the control electrode is bonded to the deformable element.

10. The normally closed microswitch of claim 8 wherein the second switch electrode is supported by the spacing structure.

11. The normally closed microswitch of claim 8 wherein the second switch electrode is electrically attached to the control electrode.

12. The normally closed microswitch of claim 8 wherein the opposing anchor edges form a closed perimeter, all edges of the deformable element are attached to the opposing anchor edges and the deformable element forms a portion of a wall of the chamber wherein the first layer is located towards the interior of the chamber.

13. The normally closed microswitch of claim 8 wherein the opposing anchor edges do not form a closed perimeter, a free edge portion of the deformable element is not attached to the opposing anchor edges and the deformable element resides within the chamber.

14. The normally closed microswitch of claim 8 wherein the apparatus adapted to apply a heat pulse to the deformable element comprises an electroresistive element in good thermal contact with the deformable element.

15. The normally closed microswitch of claim 14 wherein the electroresistive element is laminated to a side of the second layer opposite to the first layer.

16. The normally closed microswitch of claim 14 wherein the electroresistive element is laminated to a side of the second layer adjacent to the first layer.

17. The normally closed microswitch of claim 8 wherein the second material is an electrically resistive material and the apparatus adapted to apply a heat pulse to the deformable element comprises a pair of heater electrodes connected to the second layer to allow an electrical current to be passed through a portion of the second layer.

18. The normally closed microswitch of claim 17 wherein the electrically resistive material is titanium aluminide.

19. The normally closed microswitch of claim 8 wherein the apparatus adapted to apply a heat pulse to the deformable element comprises light directing elements to allow light energy pulses to impinge the deformable element.

20. The normally closed microswitch of claim 8 wherein the deformable element is constructed as a planar lamination of a plurality of layers and the residual shape of the deformable element results from an accumulation of residual stains in the plurality of layers.

21. The normally closed microswitch of claim 8 wherein the deformable element is formed over a mold having a mold depression, the second layer laminated above the first layer, resulting in the residual shape when the deformable element is released from the mold and attached to the base element.

22. The normally closed microswitch of claim 8 wherein the opposing anchor edges are comprised of an edge material having a Young's modulus substantially smaller than an effective Young's modulus of the planar lamination of the deformable element, and wherein the deformable element is bonded to the opposing anchor edges causing a semi-rigid connection to be formed.

23. The normally closed microswitch of claim 8 wherein the edge material is a polymer which may be used and processed reliably at temperatures of at least 300° C.

24. The normally closed microswitch of claim 8 wherein the base element is formed in a substrate with a depression having opposing anchor edges and a relief portion of substrate material near the anchor edges is removed, substantially decreasing the stiffness of the opposing anchor edges, and wherein the deformable element is bonded to the opposing anchor edges causing a semi-rigid connection to be formed.

25. The normally closed microswitch of claim 8 wherein the deformable element has a narrow perimeter portion and a central portion, the narrow perimeter portion constructed to have a perimeter stiffness which is substantially higher than a central stiffness of the central portion, and wherein the narrow perimeter portion is bonded to the opposing edges causing a semi-rigid connection to be formed.

26. A normally open microswitch for controlling an electrical circuit comprising;

(a) a base element formed with a depression having opposing anchor edges, said opposing anchor edges defining a central plane;

(b) a spacing structure supported by the base element;

(c) a first switch electrode supported by the spacing structure, a second switch electrode spaced away from the first switch electrode, and a control electrode for electrically connecting the first and second switch electrodes to close the electrical circuit;

(d) a deformable element attached to the opposing anchor edges positioning the control electrode in close proximity to the first switch electrode, the deformable element constructed as a planar lamination including a first layer of a first material having a low coefficient of thermal expansion and a second layer of a second material having a high coefficient of thermal expansion, the deformable element formed to have a residual shape bowing outward from the central plane in a first direction away from the second layer and away from the first switch electrode; and (e) apparatus adapted to apply a heat pulse to the deformable element, causing a sudden rise in the temperature of the deformable element, the deformable element initially bowing farther outward in the first direction, then, due to thermomechanical torque's acting at the opposing anchor edges, reversing and snapping through the central plane to bow outward in a second direction toward the second layer, moving the control electrode into contact with the first switch electrode and second switch electrode thereby closing the electrical circuit, and then relaxing to the residual shape, opening the electrical circuit as the temperature decreases thereof.

27. The normally open microswitch of claim 26 wherein the second switch electrode is supported by the spacing structure.

28. The normally open microswitch of claim 26 wherein the second switch electrode is electrically attached to the control electrode.

29. The normally open microswitch of claim 26 wherein the apparatus adapted to apply a heat pulse to the deformable element comprises an electroresistive element in good thermal contact with the deformable element.

30. The normally open microswitch of claim 26 wherein the second material is an electrically resistive material and the apparatus adapted to apply a heat pulse to the deformable element comprises a pair of heater electrodes connected to the second layer to allow an electrical current to be passed through a portion of the second layer.

31. The normally open microswitch of claim 26 wherein the apparatus adapted to apply a heat pulse to the deformable element comprises light directing elements to allow light energy pulses to impinge the deformable element.

32. The normally open microswitch of claim 26 wherein the deformable element is constructed as a planar lamination of a plurality of layers and the residual shape of the deformable element results from an accumulation of residual stains in the plurality of layers.

33. A normally open microswitch for controlling an electrical circuit comprising;

(a) a base element formed with a depression having opposing anchor edges, said opposing anchor edges defining a central plane;

(b) a spacing structure supported by the base element;

(c) a first switch electrode supported by the spacing structure, a second switch electrode spaced away from the first switch electrode, and a control electrode for electrically connecting the first and second switch electrodes to close the electrical circuit;

(d) a deformable element attached by a semi-rigid connection to the opposing anchor edges positioning the control electrode in close proximity to the first switch electrode, the deformable element constructed as a planar lamination including a first layer of a first material having a low coefficient of thermal expansion and a second layer of a second material having a high coefficient of thermal expansion, the deformable element formed to have a residual shape bowing outward from the central plane in a first direction away from the second layer and away from the first switch electrode; and (e) apparatus adapted to apply a heat pulse to the deformable element, causing a sudden rise in the temperature of the deformable element, the deformable element initially bowing farther outward in the first direction, then reversing and snapping through the central plane to bow outward in a second direction toward the second layer, moving the control electrode into contact with the first switch electrode and second switch electrode thereby closing the electrical circuit, and then relaxing to the residual shape, opening the electrical circuit as the temperature decreases thereof.

34. The normally open microswitch of claim 33 wherein the control electrode is bonded to the deformable element.

35. The normally open microswitch of claim 33 wherein the second switch electrode is supported by the spacing structure.

36. The normally open microswitch of claim 33 wherein the second switch electrode is electrically attached to the control electrode.

37. The normally open microswitch of claim 33 wherein the opposing anchor edges form a closed perimeter, all edges of the deformable element are attached to the opposing anchor edges and the deformable element forms a portion of a wall of the chamber wherein the first layer is located towards the interior of the chamber.

38. The normally open microswitch of claim 33 wherein the opposing anchor edges do not form a closed perimeter, a free edge portion of the deformable element is not attached to the opposing anchor edges and the deformable element resides within the chamber.

39. The normally open microswitch of claim 33 wherein the apparatus adapted to apply a heat pulse to the deformable element comprises an electroresistive element in good thermal contact with the deformable element.

40. The normally open microswitch of claim 39 wherein the electroresistive element is laminated to a side of the second layer opposite to the first layer.

41. The normally closed microswitch of claim 39 wherein the electroresistive element is laminated to a side of the second layer adjacent to the first layer.

42. The normally open microswitch of claim 33 wherein the second material is an electrically resistive material and the apparatus adapted to apply a heat pulse to the deformable element comprises a pair of heater electrodes connected to the second layer to allow an electrical current to be passed through a portion of the second layer.

43. The normally open microswitch of claim 42 wherein the electrically resistive material is titanium aluminide.

44. The normally open microswitch of claim 33 wherein the apparatus adapted to apply a heat pulse to the deformable element comprises light directing elements to allow light energy pulses to impinge the deformable element.

45. The normally open microswitch of claim 33 wherein the deformable element is constructed as a planar lamination of a plurality of layers and the residual shape of the deformable element results from an accumulation of residual stains in the plurality of layers.

46. The normally open microswitch of claim 33 wherein the deformable element is formed over a mold having a mold depression, the second layer laminated above the first layer, resulting in the residual shape when the deformable element is released from the mold and attached to the base element.

47. The normally open microswitch of claim 33 wherein the opposing anchor edges are comprised of an edge material having a Young's modulus substantially smaller than an effective Young's modulus of the planar lamination of the deformable element, and wherein the deformable element is bonded to the opposing anchor edges causing a semi-rigid connection to be formed.

48. The normally open microswitch of claim 47 wherein the edge material is a polymer which may be used and processed reliably at temperatures of at least 300° C.

49. The normally open microswitch of claim 33 wherein the base element is formed in a substrate with a depression having opposing anchor edges and a relief portion of substrate material near the anchor edges is removed, substantially decreasing the stiffness of the opposing anchor edges, and wherein the deformable element is bonded to the opposing anchor edges causing a semi-rigid connection to be formed.

50. The normally open microswitch of claim 33 wherein the deformable element has a narrow perimeter portion and a central portion, the narrow perimeter portion constructed to have a perimeter stiffness which is substantially higher than a central stiffness of the central portion, and wherein the narrow perimeter portion is bonded to the opposing edges causing a semi-rigid connection to be formed.

* * * * *